US011673757B2

(12) United States Patent
Sano et al.

(10) Patent No.: US 11,673,757 B2
(45) Date of Patent: Jun. 13, 2023

(54) IMAGE FORMING APPARATUS

(71) Applicant: BROTHER KOGYO KABUSHIKI KAISHA, Nagoya (JP)

(72) Inventors: Toshiyuki Sano, Aichi-ken (JP); Shintaro Sakaguchi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 655 days.

(21) Appl. No.: 16/794,873

(22) Filed: Feb. 19, 2020

(65) Prior Publication Data

US 2020/0277155 A1 Sep. 3, 2020

(30) Foreign Application Priority Data

Feb. 28, 2019 (JP) ..... JP2019-036544

(51) Int. Cl.

| | |
|---|---|
| ***B65H 29/58*** | (2006.01) |
| ***G03G 15/00*** | (2006.01) |
| ***B65H 29/12*** | (2006.01) |
| ***B65H 15/00*** | (2006.01) |
| ***B65H 85/00*** | (2006.01) |

(52) U.S. Cl.

CPC ..... *B65H 29/58* (2013.01); *B65H 15/00* (2013.01); *B65H 29/12* (2013.01); *B65H 85/00* (2013.01); *G03G 15/6529* (2013.01); *G03G 15/6552* (2013.01)

(58) Field of Classification Search

CPC ..... B65H 29/58; B65H 15/00; B65H 29/12; B65H 85/00; G03G 15/6529; G03G 15/6552

See application file for complete search history.

(56) References Cited

U.S. PATENT DOCUMENTS

| | | | | |
|---|---|---|---|---|
| 2003/0116911 | A1* | 6/2003 | Kanai | B65H 29/14 271/303 |
| 2015/0274469 | A1 | 10/2015 | Mori et al. | |
| 2016/0176677 | A1* | 6/2016 | Mizuguchi | B65H 5/062 271/225 |
| 2018/0170701 | A1* | 6/2018 | Mizuguchi | B65H 9/004 |
| 2018/0362283 | A1* | 12/2018 | Yamamoto | B65H 31/24 |
| 2020/0201223 | A1* | 6/2020 | Nishiyama | G03G 15/6538 |

FOREIGN PATENT DOCUMENTS

| | | |
|---|---|---|
| JP | 2002-337417 A | 11/2002 |
| JP | 2016-71224 A | 5/2016 |

* cited by examiner

*Primary Examiner* — Thomas A Morrison
(74) *Attorney, Agent, or Firm* — Merchant & Gould P.C.

(57) ABSTRACT

An image forming apparatus includes: a main apparatus body having an image forming unit and a discharge tray; and a controller. The main apparatus body includes a conveyance path along which a sheet passed through the image forming unit is conveyed; a discharge path branched from the conveyance path and connected to the discharge tray; and a reconveyance path having a first path different from the discharge path and a second path for conveying the sheet to the image forming unit. In a double-sided printing, if a first sheet has passed through the first path when a forward end of a second sheet arrives at a predetermined position in the conveyance path, the controller conveys the second sheet to the first path and then conveys the second sheet to the second path.

10 Claims, 18 Drawing Sheets

IMAGE FORMING APPARATUS

CROSS REFERENCE TO RELATED APPLICATION

The present application claims priority from Japanese Patent Application No. 2019-036544, filed on Feb. 28, 2019, the disclosure of which is incorporated herein by reference in its entirety.

BACKGROUND

Field of the Invention

The present invention relates to an image forming apparatus.

Description of the Related Art

Conventionally, in relation to the image forming apparatus which makes it possible to perform the double-sided printing on the sheet, it is intended to improve the printing speed of the double-sided printing by shortening the conveyance space (conveyance interval) between a plurality of sheets. As for the sheet conveyance control of this type, for example, such conveyance control is known that the printing is performed on the back surface of the first sheet, and then the second sheet is fed before performing the printing on the front surface of the first sheet to perform the printing on the back surface of the second sheet. In the case of this conveyance control, the printing is performed on the back surface of the second sheet between the printing on the back surface of the first sheet and the printing on the front surface of the first sheet. Therefore, it is possible to improve the printing speed of the double-sided printing by shortening the conveyance space between the sheets.

Further, the following conveyance control is also known as the sheet conveyance control when the double-sided printing is performed. That is, the printing is performed, for example, in an order of "back surface of the first sheet (second page)"→"back surface of the second sheet (fourth page)"→"back surface of the third sheet (sixth page)"→"front surface of the first sheet (first page)".

Further, another image forming apparatus, which can perform the double-sided printing, is known, the image forming apparatus comprising a discharge path for discharging the sheet conveyed from an image forming unit to a discharge tray, and a reconveyance path for conveying the sheet conveyed from the image forming unit to the image forming unit again by switchbacking the sheet. If the sheet conveyance control described above is applied to the image forming apparatus as described above, the following configuration is conceived. That is, in order to perform the printing most quickly with respect to a plurality of sheets, the sheet is switchbacked and reconveyed to the image forming unit by using the discharge path only when the printing is terminated on the back surface of the second sheet (fourth page). As for the other sheets (for example, the first sheet and the third sheet), the sheet is switchbacked by using the reconveyance path to reconvey the sheet to the image forming unit after the printing is terminated on the back surface (for example, the second page, the sixth page).

SUMMARY

However, as described above, in the case of the configuration in which the sheet is switchbacked by using the discharge path after the printing is terminated on the back surface of the second sheet (fourth page), such a state is given that the sheet protrudes on the discharge tray when the sheet is switchbacked. Therefore, it is feared that the user may remove the protruding sheet while misunderstanding that the protruding sheet is discharged to the discharge tray. Further, it is feared that the sheet, which protrudes to the discharge tray, may make contact with the sheet having been already discharged to the discharge tray, and the discharged sheet may be extruded.

The present teaching has been made in order to solve the foregoing problems. That is, an object is to provide an image recording apparatus which can suppress, for example, the contact of the user with the sheet subjected to the switchback by performing the switchback by conveying, to a reconveyance path, the second sheet for which the printing has been terminated on the back surface (fourth page) if the second sheet, for which the printing is to be performed on the back surface (fourth page), undergoes the conveyance delay due to, for example, any mistake in the paper feed and the reconveyance path is in a vacant state. Another object is to provide an image recording apparatus which makes it possible to realize a high speed of the double-sided printing by performing the switchback by conveying, to a discharge path, the second sheet for which the printing has been terminated on the back surface (fourth page) if the second sheet, for which the printing is to be performed on the back surface (fourth page), does not undergo the occurrence of conveyance delay.

According to an aspect of the present teaching, there is provided an image forming apparatus including: a main apparatus body having an image forming unit and a discharge tray; and a controller, wherein the main apparatus body includes: a conveyance path along which a sheet passed through the image forming unit is conveyed; a discharge path which is branched from the conveyance path and which is connected to the discharge tray; and a reconveyance path having a first path and a second path, the first path being branched from the conveyance path and different from the discharge path, the second path being branched from the discharge path and the first path and for conveying the sheet to the image forming unit, and in a case of executing double-sided printing in which the sheet passed through the image forming unit is conveyed again to the image forming unit via the second path, under a condition that a second sheet is fed next to a first sheet, and that the first sheet has passed through the first path when a forward end of the second sheet arrives at a predetermined position in the conveyance path, the controller is configured to convey the second sheet to the first path and then convey the second sheet to the second path, and under a condition that the first sheet has not passed through the first path when the forward end of the second sheet arrives at the predetermined position in the conveyance path, the controller is configured to convey the second sheet to the discharge path and then convey the second sheet to the second path.

According to the present teaching, if any delay occurs in the paper feed of the second sheet, it is possible to suppress the user from making contact with the second sheet which protrudes from the main apparatus body, and it is possible to suppress the second sheet protruding from the main apparatus body from making contact with the sheet having been already discharged to the discharge tray and from extruding the same sheet having been already discharged. Further, if any delay does not occur in the paper feed of the second sheet, it is possible to realize a high speed of the double-sided printing.

BRIEF DESCRIPTION OF THE DRAWINGS

FIGS. 5A and 5B depict sectional views taken along the center line of the image forming apparatus, wherein FIG. 5A depicts a state in which the forward end of a fed first sheet is disposed at a position before arrival at a flapper and a second sheet is fed, and FIG. 5B depicts a state in which the first sheet is conveyed along a first path and the second sheet is conveyed along a conveyance path.

FIGS. 6A and 6B depict sectional views taken along the center line of the image forming apparatus, wherein FIG. 6A depicts a state in which the first sheet is conveyed toward a second path while reversing the conveyance direction and the second sheet is conveyed along the conveyance path, and FIG. 6B depicts a state in which the first sheet passes along the first path and the second sheet is conveyed along the discharge path.

FIGS. 7A and 7B depict sectional views taken along the center line of the image forming apparatus, wherein FIG. 7A depicts a state in which the conveyance of the first sheet is stopped in a state in which the first sheet is interposed by second reconveyance rollers in the second path and the conveyance direction of the second sheet is reversed in the discharge path, and FIG. 7B depicts a state in which the conveyance of the first sheet is stopped in a state in which the first sheet is interposed by the second reconveyance rollers in the second path, the forward end of the second sheet arrives at a position of intermediate reverse rollers 75, and the paper feed of a third sheet is started.

FIGS. 9A and 9B depict sectional views taken along the center line of the image forming apparatus, wherein FIG. 9A depicts a state in which the paper feed of the second sheet is delayed, the conveyance direction of the first sheet is revered to convey the first sheet toward the second path, and the forward end of the second sheet is not detected by a first sensor yet, and FIG. 9B depicts a state in which the paper feed of the second sheet is delayed, the first sheet passes through the first path, and the second sheet is conveyed to a position before the flapper.

FIGS. 10A and 10B depict sectional views taken along the center line of the image forming apparatus, wherein FIG. 10A depicts a state in which the paper feed of the second sheet is delayed, the conveyance of the first sheet is stopped in a state in which the first sheet is interposed by the second reconveyance rollers in the second path, and the second sheet is conveyed along the first path, and FIG. 10B depicts a state in which the paper feed of the second sheet is delayed, the conveyance of the first sheet is stopped in a state in which the first sheet is interposed by the second reconveyance rollers in the second path, the forward end of the second sheet arrives at the position of the intermediate reverse rollers, and the paper feed of the third sheet is started.

DESCRIPTION OF THE EMBODIMENTS

Next, an embodiment to carry out the present teaching will be explained with reference to the accompanying drawings.

<Image Forming Apparatus>

Figure 1:
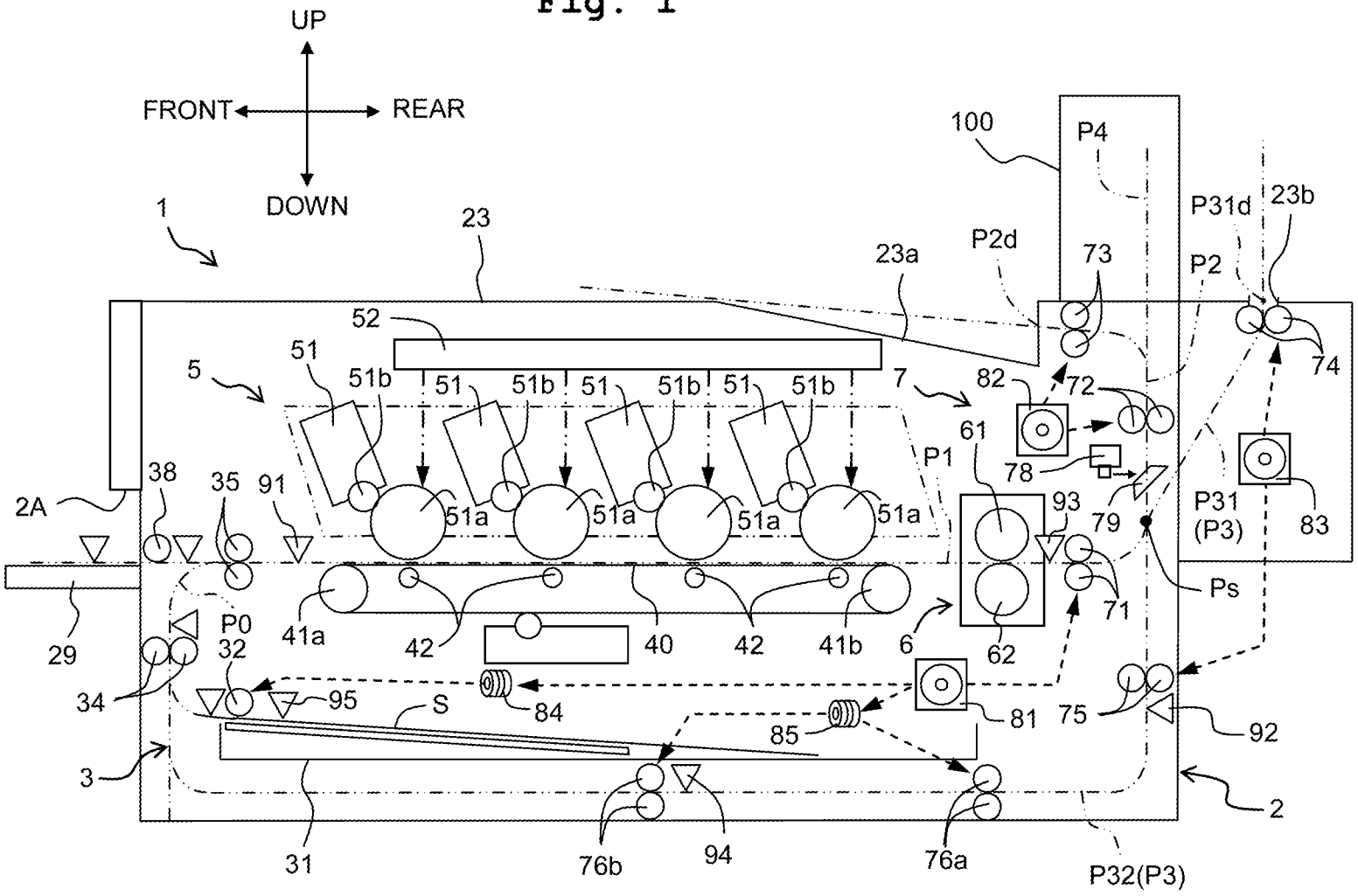
FIG. 1 depicts a sectional view taken along a center line illustrating an image forming apparatus to which a discharge unit is installed.

An image forming apparatus 1 depicted in FIG. 1 is an embodiment of the image forming apparatus according to the present teaching. The image forming apparatus 1 is a color laser printer for forming an image by overlaying developer images of a plurality of colors on a sheet S of recording paper, OHP sheet or the like by means of the electrophotographic system. However, the image forming apparatus 1 may be a monochrome or black and white laser printer for forming an image based on a single color developer image on a sheet. Alternatively, the image forming apparatus 1 may be an ink-jet printer.

In the following description, "left side", "right side", "back side with respect to the paper surface", and "front side with respect to the paper surface" as viewed in FIG. 1 are defined as "front side", "back side", "left side", and "right side" of the image forming apparatus 1 respectively. Further, "upper side" and "lower side" as viewed in FIG. 1 are defined as "upper side" and "lower side" of the image forming apparatus 1 respectively.

The image forming apparatus 1 is provided with a main apparatus body 2, a paper feed unit 3 which supplies the sheet S, an image forming unit 5 which forms an image on the conveyed sheet S, and a conveyance unit 7 which conveys the sheet S conveyed from the image forming unit 5. The main apparatus body 2 is a box-shaped member which is formed to have a substantially rectangular parallelepiped shape. The main apparatus body 2 accommodates the paper feed unit 3, the image forming unit 5, and the conveyance unit 7.

A discharge tray 23*a*, which is indented or recessed to be inclined downwardly from the front side toward the back side, is formed on an upper surface 23 of the main apparatus body 2. In this way, the main apparatus body 2 has the image forming unit 5 and the discharge tray 23*a*.

The paper feed unit 3 is provided with a sheet cassette 31, a first paper feed roller 32, a pair of first conveyance rollers 34, and a pair of resist rollers 35. A paper feed path P0 is configured in the main apparatus body 2 in order to feed the sheet S from the sheet cassette 31 to the image forming unit 5.

The sheet cassette 31 supports a plurality of sheets S in a stacked state. The sheet cassette 31 is an example of the sheet tray which supports the sheet to be fed to the image forming unit 5. The sheet S, which is supported by the sheet cassette 31, is fed one by one to the paper feed path P0 by means of the first paper feed roller 32. The sheet S, which has been fed to the paper feed path P0, is conveyed toward the image forming unit 5 by means of the first conveyance rollers 34 and the resist rollers 35.

Further, the main apparatus body 2 is provided with an opening 2A which is open on the front surface, and a front cover 29 which is capable of opening/closing the opening 2A. The opening 2A is open in a state in which the front cover 29 is open, or the opening 2A is closed in a state in which the front cover 29 is closed.

The paper feed unit 3 is provided with a second paper feed roller 38. The sheet S, which is placed on the front cover 29 in the state in which the front cover 29 is open, is fed to the paper feed path P0 by means of the second paper feed roller 38. The sheet S, which has been fed to the paper feed path P0, is conveyed toward the image forming unit 5 by means of the resist rollers 35. The front cover 29, which is in the open state, is an example of the sheet tray which supports the sheet.

The image forming unit 5 is provided with four drum units 51 which are provided and aligned in the front-back direction. The respective drum units 51 are provided while corresponding to the respective colors of black, yellow, magenta, and cyan. Each of the drum units 51 is provided with a photosensitive drum 51*a* and a developing roller 51*b*.

Further, the image forming unit 5 is provided with a scanner unit 52 and a fixing unit 6. The scanner unit 52 is provided at an upper portion in the main apparatus body 2, wherein the laser beam, which is based on the image data, passes along, for example, a polygon mirror, a lens, and a reflecting mirror, and the laser beam is radiated onto the surface of the photosensitive drum 51 corresponding to each of the colors in accordance with the high speed scanning. The fixing unit 6 is arranged on the more downstream side as compared with the photosensitive drum 51*a* which is disposed on the most downstream side in the conveyance direction of the sheet S.

A transfer belt 40 is arranged under the drum units 51 in the image forming unit 5. The transfer belt 40 is applied and stretched between a driving roller 41*a* and a driven roller 41*b* which is arranged at the back of the driving roller 41*a*. Transfer rollers 42 are arranged respectively at positions opposed to the respective photosensitive drums 51*a* with the transfer belt 40 intervening therebetween.

In the image forming unit 5, the photosensitive drums 51*a*, which are uniformly electrified (charged) by unillustrated electrifiers (chargers), are selectively exposed by the scanner unit 52 respectively. In accordance with the exposure, the electric charges are selectively removed from the surfaces of the photosensitive drums 51*a*, and electrostatic latent images are formed on the surfaces of the photosensitive drums 51*a*.

The development bias is applied to the developing roller 51*b*. When the electrostatic latent image, which is formed on the photosensitive drum 51*a*, is opposed to the developing roller 51*b*, the toner is supplied from the developing roller 51*b* to the electrostatic latent image in accordance with the difference in electric potential between the electrostatic latent image and the developing roller 51*b*.

When the sheet S, which is conveyed toward the image forming unit 5, is conveyed onto the transfer belt 40, then the sheet S is conveyed by the transfer belt 40, and the sheet S successively passes through the space between the transfer belt 40 and each of the photosensitive drums 51*a*. Then, the toner image, which is formed on the surface of the photosensitive drum 51*a*, is transferred to the sheet S in accordance with the transfer bias applied to the transfer roller 42 when the toner image is opposed to the sheet S.

The sheet S, to which the toner image has been transferred, is conveyed to the fixing unit 6. The fixing unit 6 is provided with a heating roller 61 which heats the sheet S, and a pressurizing roller 62 which is arranged opposingly to the heating roller 61. The sheet S, which is conveyed to the fixing unit 6, passes through the space between the heating roller 61 and the pressurizing roller 62 which are brought in contact with each other under the pressure. Thus, the toner image is thermally fixed.

The sheet S, on which the toner image has been thermally fixed, is conveyed to the downstream side of the image forming unit 5 by means of the conveyance unit 7. The conveyance unit 7 has a conveyance path P1, a discharge path P2, and a reconveyance path P3. The conveyance path P1 is a path along which the sheet S conveyed from the image forming unit 5 is conveyed. The discharge path P2 is a path which is branched from the conveyance path P1 and along which the sheet S is conveyed to the discharge tray 23*a*. The reconveyance path P3 has a first path P31 which is branched from the conveyance path P1 and along which the sheet S is temporarily conveyed, and a second path P32 which is branched from the discharge path P2 and the first path P31 and along which the sheet S is conveyed to the image forming unit 5.

A pair of post-fixation rollers 71, which convey the sheet, are provided on the downstream side in the sheet conveyance direction as compared with the fixing unit 6 in the conveyance path P1. A pair of discharge rollers 73, which convey the sheet S, are provided at the end portion of the discharge path P2 disposed on the downstream side in the sheet conveyance direction. A pair of intermediate discharge rollers 72, which convey the sheet S, are provided on the upstream side in the sheet conveyance direction as compared with the discharge rollers 73 in the discharge path P2.

In the reconveyance path P3, a pair of reverse rollers 74, which convey the sheet S, are provided in the first path P31. A pair of intermediate reverse rollers 75, which convey the sheet S, are provided at the end portion of the second path P32 disposed on the side of the first path P31. A pair of first reconveyance rollers 76*a* and a pair of second reconveyance rollers 76*b*, which convey the sheet S, are provided on the downstream side in the sheet conveyance direction as compared with the intermediate reverse rollers 75 in the second path P32. The second reconveyance rollers 76*b* are arranged on the downstream side in the sheet conveyance direction as compared with the first reconveyance rollers 76*a*.

A flapper 79 is provided at a branch portion Ps for branching the discharge path P2 and the first path P31 from the conveyance path P1. The flapper 79 is configured to be switchable between a first position at which the sheet S conveyed along the conveyance path P1 is guided to the discharge path P2 and a second position at which the sheet S conveyed along the conveyance path P1 is guided to the first path P31. The flapper 79 is an example of the path switching unit. A solenoid 78 is provided for the main apparatus body 2. The solenoid 78 is configured so that the flapper 79 can be switched to have the first position or the second position.

The main apparatus body 2 has a first motor 81, a second motor 82, and a third motor 83. The first motor 81 drives the first paper feed roller 32, the post-fixation rollers 71, the first reconveyance rollers 76*a*, and the second reconveyance rollers 76*b*.

A first electromagnetic clutch 84 is allowed to intervene between the first motor 81 and the first paper feed roller 32. The first electromagnetic clutch 84 can switch the transmission and the interruption of the driving force from the first motor 81 to the paper feed roller 32. A second electromagnetic clutch 85 is allowed to intervene between the first motor 81 and the first reconveyance rollers 76*a* and the second reconveyance rollers 76*b*. The second electromagnetic clutch 85 can switch the transmission and the interruption of the driving force from the first motor 81 to the first reconveyance rollers 76*a* and the second reconveyance rollers 76*b*.

The second motor 82 drives the discharge rollers 73 and the intermediate discharge rollers 72. The second motor 82 can switch the rotation directions of the discharge rollers 73 and the intermediate discharge rollers 72 to the forward rotation direction and the reverse rotation direction. The discharge rollers 73 and the intermediate discharge rollers 72 are operated such that the sheet S can be conveyed toward the discharge tray 23*a* when the rollers are rotated in the forward rotation direction, while the sheet S can be conveyed toward the second path P32 when the rollers are rotated in the reverse rotation direction. In other words, the discharge rollers 73 and the intermediate discharge rollers 72 can reverse the conveyance direction of the sheet S in the discharge path P2. When the sheet S is reversed in the discharge path P2, the forward end portion of the sheet S temporarily protrudes over the discharge tray 23*a*.

The third motor 83 drives the reverse rollers 74 and the intermediate reverse rollers 75. The third motor 83 can switch the rotation directions of the reverse rollers 74 and the intermediate reverse rollers 75 to the forward rotation direction and the reverse rotation direction. The reverse rollers 74 convey the sheet S in the direction to make separation from the conveyance path P1 when the reverse rollers 74 are rotated in the forward rotation direction, while the reverse rollers 74 convey the sheet S toward the second path P32 when the reverse rollers 74 are rotated in the reverse rotation direction.

In other words, the reverse rollers 74 and the intermediate reverse rollers 75 can reverse the conveyance direction of the sheet S in the first path P31. The main apparatus body 2 has, on the upper surface 23, an upper surface opening 23*b* through which the sheet S conveyed along the first path P31 can pass. When the sheet S is reversed in the first path P31, the forward end portion of the sheet S temporarily protrudes upwardly from the upper surface 23 via the upper surface opening 23*b*. The intermediate reverse rollers 75 convey the sheet S toward the image forming unit 5 in the second path P32 when the intermediate reverse rollers 75 are rotated in the reverse rotation direction.

A first sensor 91, which detects the sheet S, is provided between the resist rollers 35 and the image forming unit 5 in the paper feed path P0. In other words, the first sensor 91 is positioned between the sheet cassette 31 and the image forming unit 5. A second sensor 92, which detects the sheet S, is provided between the intermediate reverse rollers 75 and the first reconveyance rollers 76*a* in the second path P32. A third sensor 93, which detects the sheet S, is provided between the fixing unit 6 and the post-fixation rollers 71 in the conveyance path P1. A fourth sensor 94, which detects the sheet S, is provided between the first reconveyance rollers 76*a* and the second reconveyance rollers 76*b* in the second path P32. A fifth sensor 95, which detects the presence or absence of the sheet S supported by the sheet cassette 31, is provided for the sheet cassette 31.

A discharge unit 100, which has a discharge tray having a plurality of stages, is detachably installed to the upper surface 23 of the main apparatus body 2. The discharge unit 100 has a discharge unit path P4 along which the sheet S is conveyed. The image forming apparatus 1 is configured so that the sheet S can be conveyed to the discharge unit path P4 via the discharge path P2. The discharge unit 100 is an example of the optional device which is attachable/detachable with respect to the main apparatus body 2. The discharge unit path P4 is an example of the optional path.

Further, the sheet S, which is conveyed in the direction to make separation from the conveyance path P1 along the first path P31, can protrude upwardly from the upper surface 23 via the upper surface opening 23*b* of the upper surface 23 of the main apparatus body 2. The sheet S, which is conveyed until the sheet S protrudes upwardly from the upper surface 23, has the conveyance direction which is reversed by switching the rotation of the reverse rollers 74 from the forward rotation direction to the reverse rotation direction. The sheet S is conveyed toward the second path P32.

The discharge unit 100 is arranged between the discharge tray 23*a* and the upper surface opening 23*b* on the upper surface 23 of the main apparatus body 2. The discharge tray 23*a* is arranged in front of the discharge unit 100, and the upper surface opening 23*b* is arranged at the back of the discharge unit 100. Therefore, the sheet S, which is conveyed along the first path P31, protrudes upwardly from the upper surface 23 of the main apparatus body 2 via the upper surface opening 23*b* on the back side of the discharge tray 23*a*. In other words, the first path P31 is a path which is arranged on the side opposite to the discharge tray 23*a* with the discharge unit 100 intervening therebetween.

In this way, the sheet S, which is conveyed along the first path P31 and which protrudes upwardly as compared with the upper surface 23, protrudes upwardly at the back of the discharge unit 100. Therefore, the sheet S, which temporarily protrudes from the first path P31 when the sheet S is reversed in the first path P31, is hidden by the discharge unit 100, and the sheet S is hardly recognizable visually by the user who stands frontwardly as compared with the discharge unit 100. Accordingly, the protruding sheet S can be suppressed from being removed by the user.

Further, the length of the first path P31 from the branch portion Ps to the downstream end P31*d* of the first path P31 is formed to be longer than the length of the discharge path P2 from the branch portion Ps to the downstream end P2*d* of the discharge path P2. The downstream end P31*d* is positioned at the end portion on the downstream side in the sheet conveyance direction when the reverse rollers 74 are rotated in the forward rotation direction in the first path P31. The downstream end P2*d* is positioned at the end portion on the downstream side in the sheet conveyance direction when the discharge rollers 73 are rotated in the forward rotation direction in the discharge path P2.

Therefore, the protruding length of the sheet S, by which the sheet S protrudes from the first path P31 when the sheet S is reversed in the first path P31, is shorter than the protruding length of the sheet S by which the sheet S protrudes from the discharge path P2 when the sheet S is reversed in the discharge path P2. Therefore, the sheet S, which protrudes from the first path P31, can be suppressed from making contact with the sheet S which is discharged to the discharge tray 23*a*.

Figure 2:
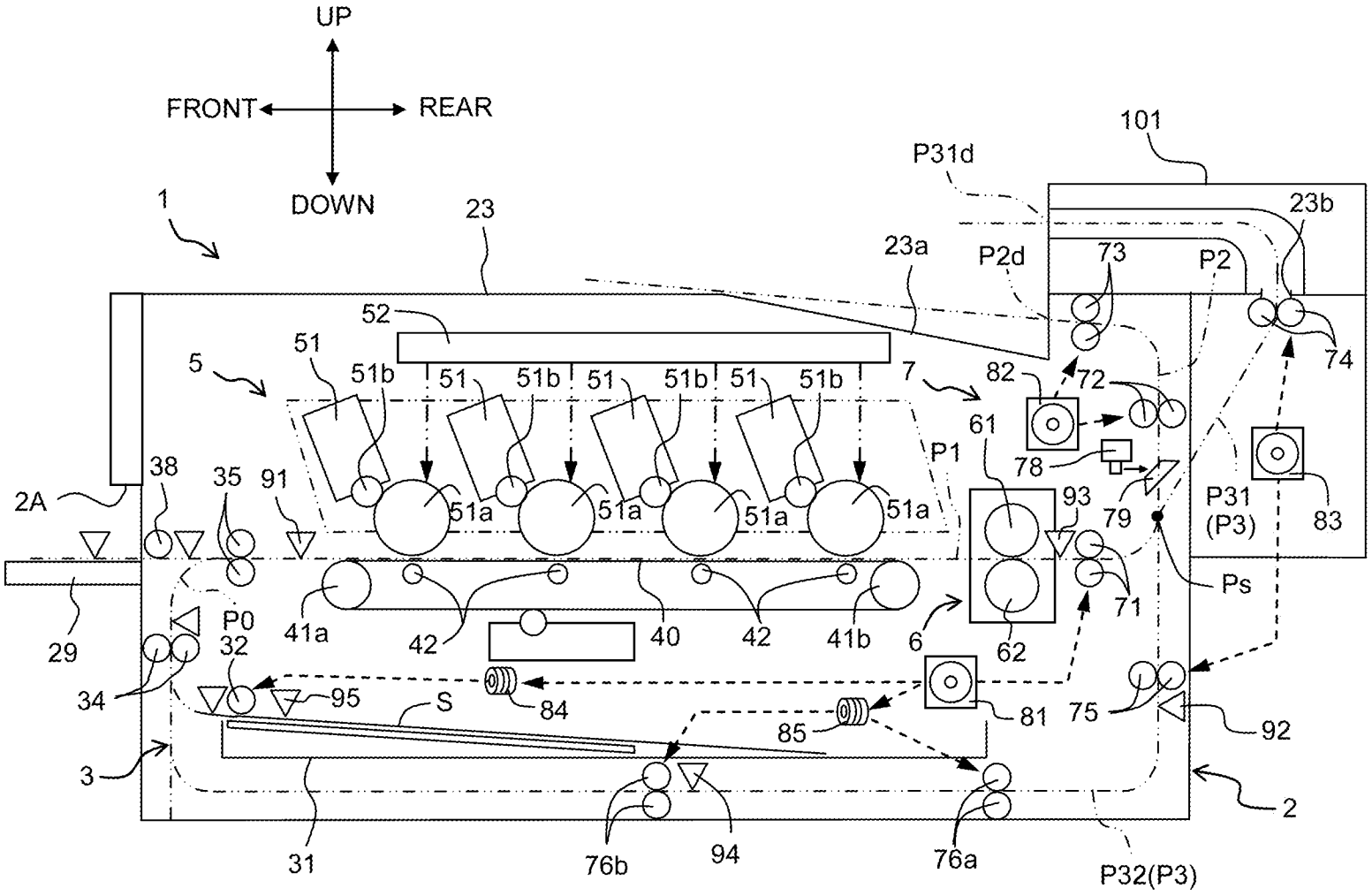
FIG. 2 depicts a sectional view taken along the center line illustrating the image forming apparatus to which a cover is installed.

As depicted in FIG. 2, a cover 101, which covers the upper surface opening 23*b*, is sometimes installed to the upper surface 23 of the main apparatus body 2, when the discharge unit 100 is not installed to the image forming apparatus 1. When the cover 101 is installed to the upper surface 23 as described above, the first path P31 is continuously formed at the inside of the cover 101 as well. The downstream end P31*d* of the first path P31 is positioned at the front end portion of the cover 101, and the downstream end P31*d* of the first path P31 is positioned upwardly as compared with the downstream end P2*d* of the discharge path P2.

In other words, the first path P31 is a path along which the sheet S conveyed from the conveyance path P1 is guided to the position disposed over or above the discharge tray 23*a*. The sheet S, which protrudes to the outside of the main apparatus body 2 from the downstream end P31*d* of the first path P31, is positioned upwardly as compared with the sheet S which is discharged from the discharge path P2 to the discharge tray 23*a*.

Therefore, when the cover 101 is installed to the upper surface 23 of the main apparatus body 2, the sheet S, which protrudes to the outside of the main apparatus body 2 from the downstream end P31*d* of the first path P31, is positioned upwardly as compared with the sheet S which is discharged from the downstream end P2*d* of the discharge path P2 to the discharge tray 23*a*. On this account, the sheet S, which protrudes from the first path P31, can be suppressed from making contact with the sheet S which has been already discharged to the discharge tray 23*a*.

Further, when the cover 101 is installed to the upper surface 23 of the main apparatus body 2, the length of the first path P31 from the branch portion Ps to the downstream end P31*d* is also formed to be longer than the length of the discharge path P2 from the branch portion Ps to the downstream end P2*d*. Therefore, the sheet S, which protrudes from the first path P31, can be further suppressed from making contact with the sheet S which is discharged to the discharge tray 23*a*.

Figure 3:
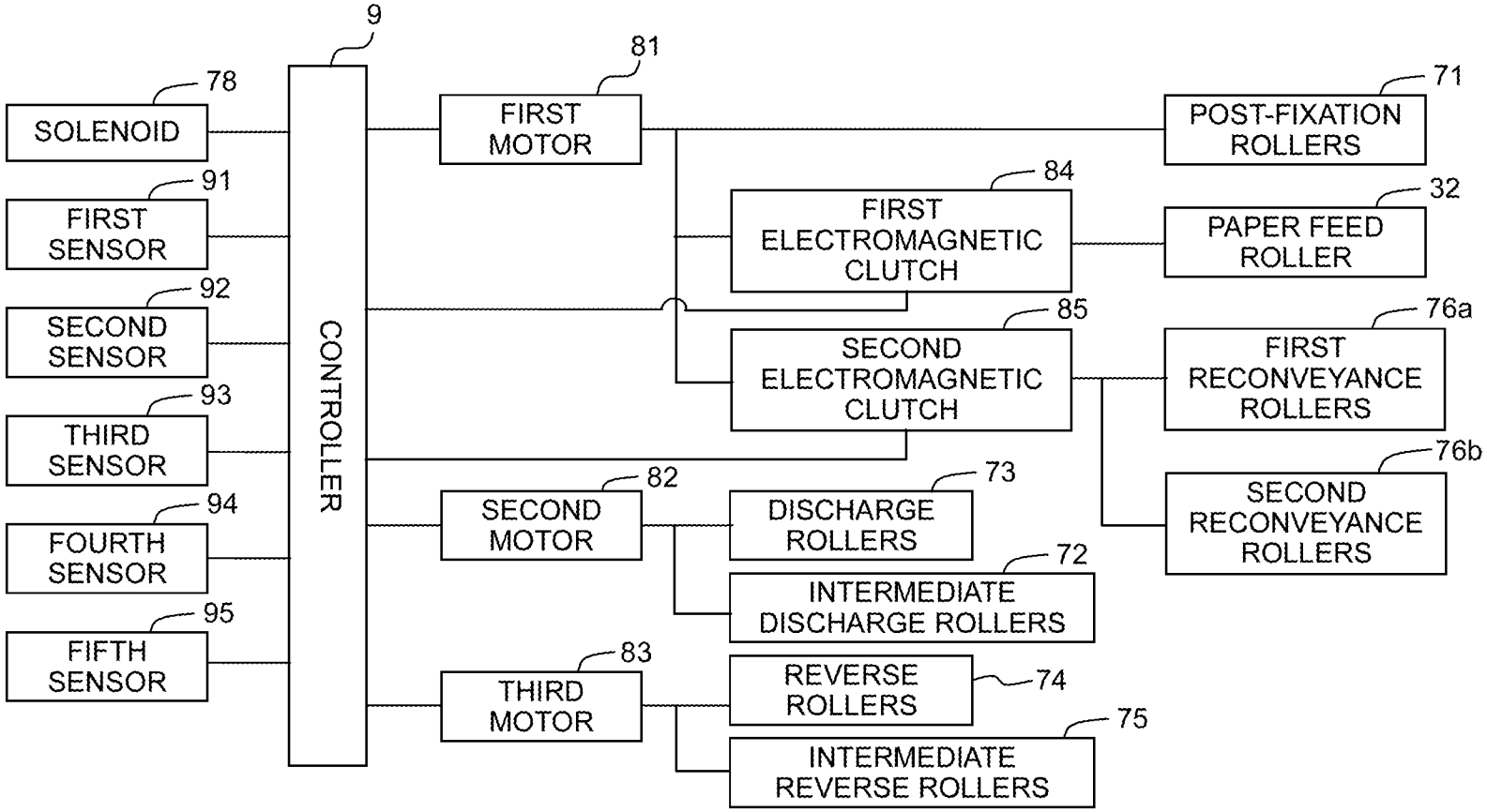
FIG. 3 depicts a block diagram illustrating a conveyance unit of the image forming apparatus.

As depicted in FIG. 3, the image forming apparatus 1 is provided with a controller 9. The solenoid 78, the first motor 81, the second motor 82, the third motor 83, the first electromagnetic clutch 84, and the second electromagnetic clutch 85 are connected to the controller 9. Further, the first sensor 91, the second sensor 92, the third sensor 93, the fourth sensor 94, and the fifth sensor 95 are connected to the controller 9.

The controller 9 can switch the flapper 79 to have the first position or the second position by controlling the solenoid 78. The controller 9 can be operated such that the flapper 79 is positioned at the first position when the sheet S is conveyed to the discharge path P2, while the flapper 79 is positioned at the second position when the sheet S is conveyed to the first path P31. In this way, when the controller 9 switches the flapper 79 to have the first position or the second position, the conveyance destination of the sheet S can be thereby switched to the discharge path P2 or the first path P31 at the appropriate timing.

The controller 9 can switch the rotation and the stop of the post-fixation rollers 71 by controlling the first motor 81. The controller 9 can switch the rotation and the stop of the first paper feed roller 32 by controlling the first motor 81 and the first electromagnetic clutch 84. The controller 9 can switch the rotation and the stop of the first reconveyance rollers 76*a* and the second reconveyance rollers 76*b* by controlling the first motor 81 and the second electromagnetic clutch 85.

The controller 9 can switch the rotation direction and switch the rotation and the stop of the discharge rollers 73 and the intermediate discharge rollers 72 by controlling the second motor 82. The controller 9 can switch the rotation direction and switch the rotation and the stop of the reverse rollers 74 and the intermediate reverse rollers 75 by controlling the third motor 83.

In the image forming apparatus 1 configured as described above, when the double-sided printing is performed to form images on the both surfaces of the sheet S, the controller 9 executes the conveyance control in which the printing is performed on the sheet S in accordance with such a printing sequence that the space between the conveyed sheets S can be shortened. Accordingly, it is intended to improve the printing speed. For example, the controller 9 is configured so that the conveyance control (hereinafter referred to as "2461 conveyance control") can be executed, in which the printing is performed in an order of "back surface of the first sheet (second page)"→"back surface of the second sheet (fourth page)"→"back surface of the third sheet (sixth page)"→"front surface of the first sheet (first page)".

When the 2461 conveyance control is performed by the controller 9, in order to perform the printing at the fastest speed on a plurality of sheets S, the high speed conveyance control is executed such that the sheet S is revered by using the discharge path P2 to reconvey the sheet S to the image forming unit 5 only when the printing is terminated by the image forming unit 5 on the back surface of the second sheet (fourth page). As for the other sheets S (for example, the first sheet S and the third sheet S), the sheet S is reversed in the first path P31 after terminating the printing on the back surface (for example, second page, sixth page), and the sheet S is reconveyed to the image forming unit 5.

Further, the paper feed is delayed, for example, due to any mistake in the paper feed for the second sheet S for which the printing is performed on the back surface (fourth page) in some cases. In such a situation, the conveyance switching control is executed such that when the second sheet S, for which the printing is terminated on the back surface (fourth page), arrives at the position in front of the flapper 79, if the first path P31 is in the vacant state, then the second sheet S is reversed in the first path P31, and the second sheet S is reconveyed to the image forming unit 5.

<Conveyance Control>

Figure 4A:
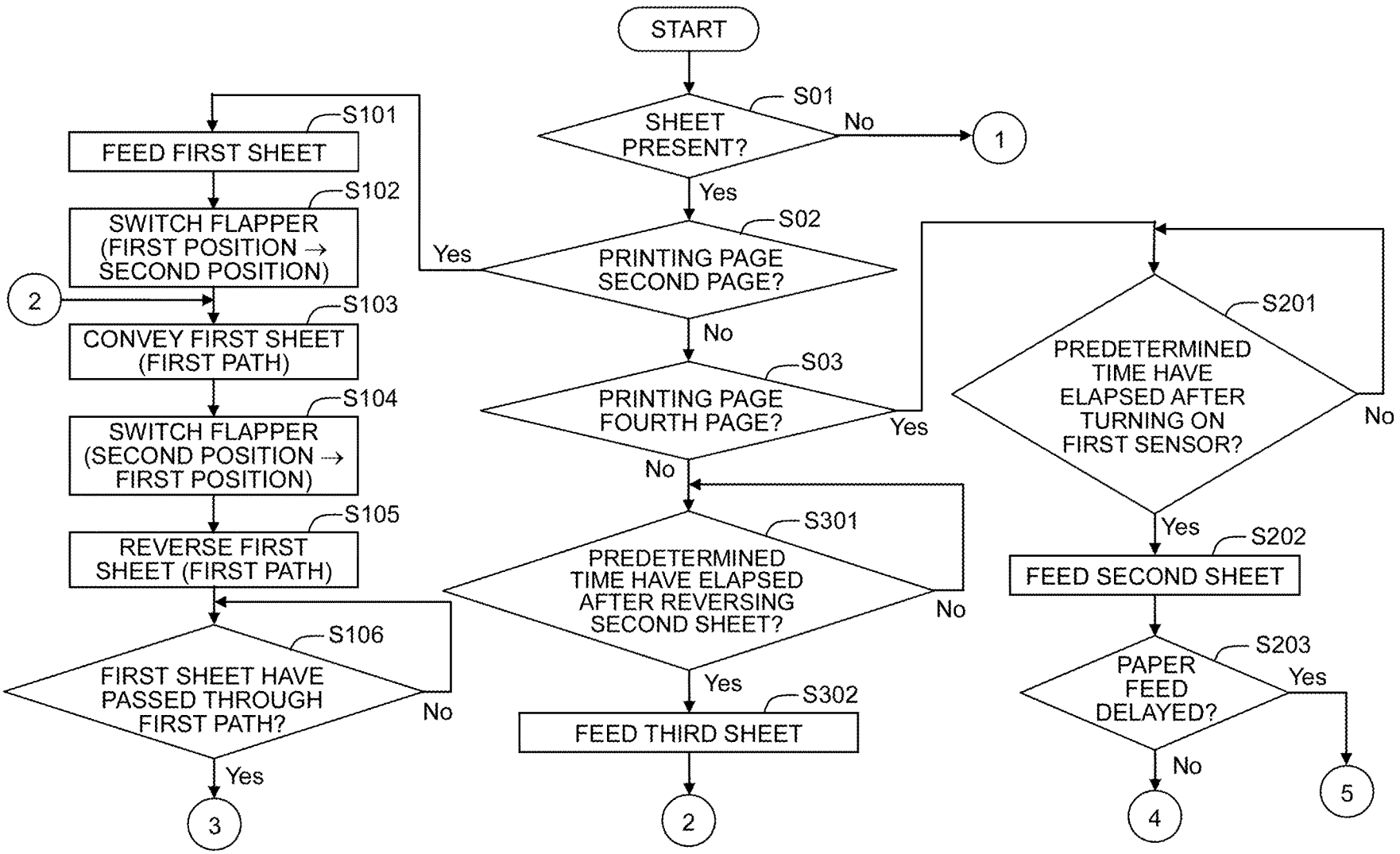
FIGS. 4A to 4C depict a flow chart of the conveyance control.
Figure 4B:
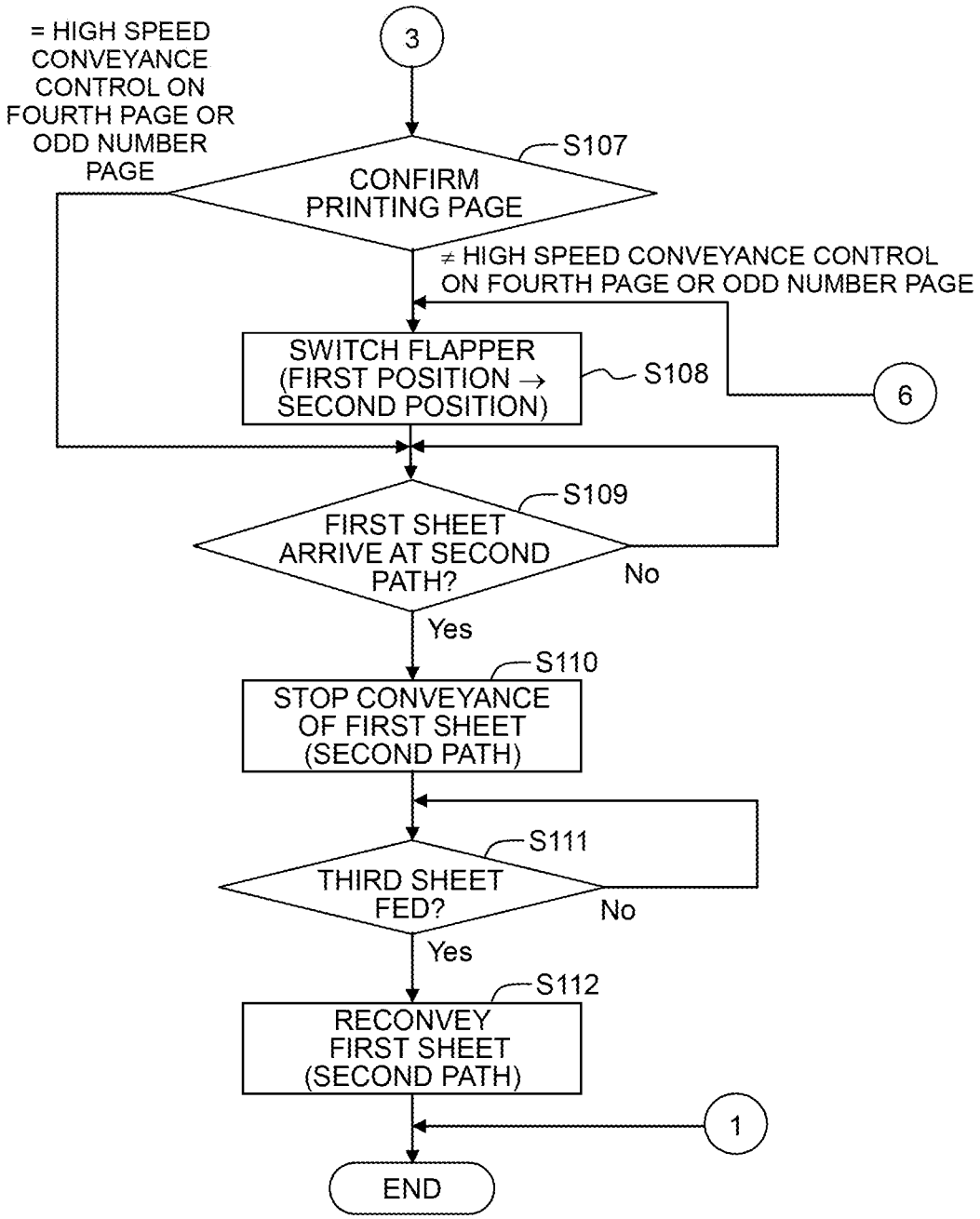
Figure 4C:
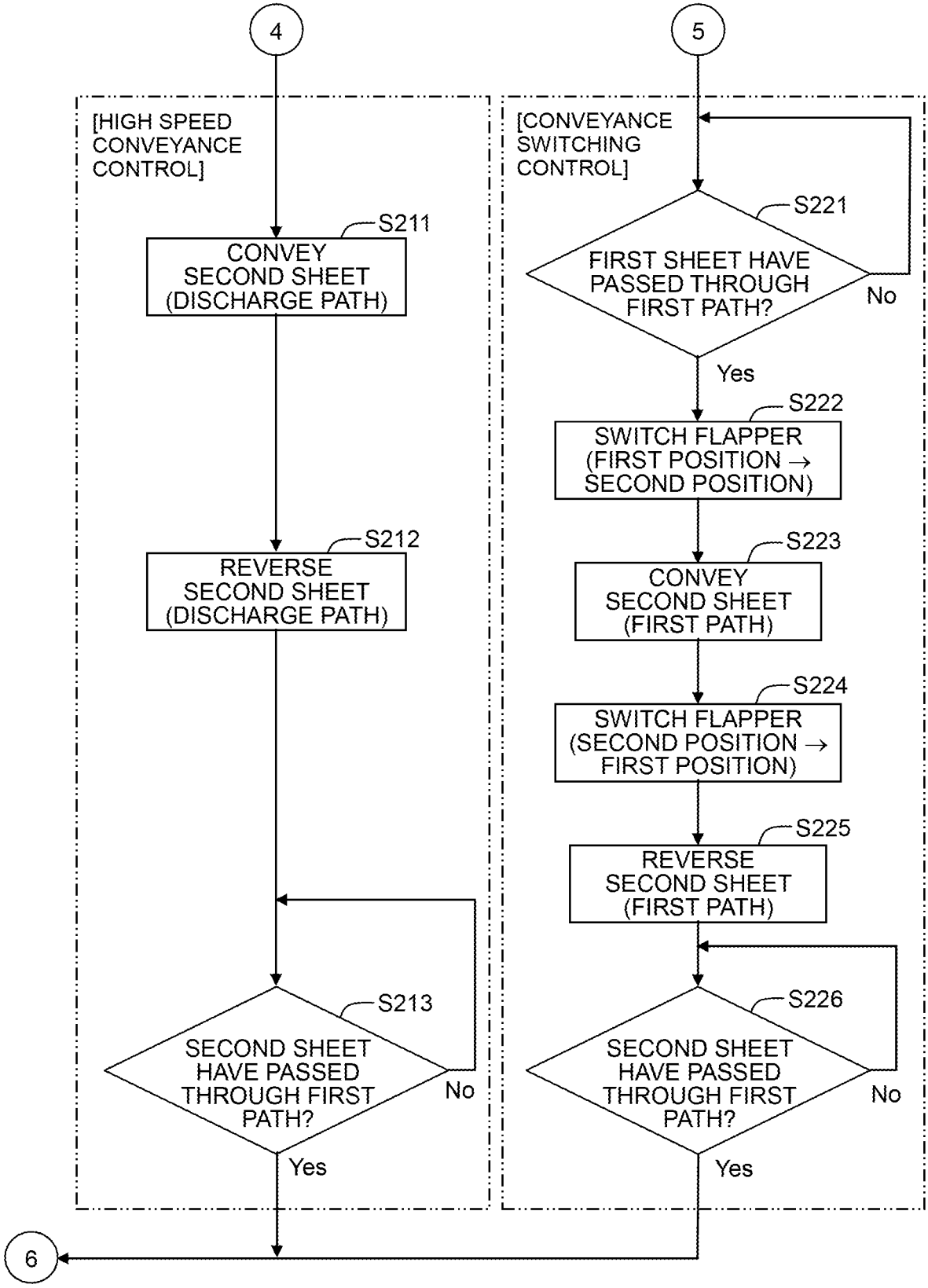

Next, an explanation will be made with reference to FIGS. 4A to 4C about the conveyance control of the sheet S to be performed during the double-sided printing executed by the controller 9, especially the high speed conveyance control and the conveyance switching control to be performed when the 2461 conveyance control is executed.

Note that in the following explanation, the first sheet S, for which the second page is printed on the back surface, is referred to as "first sheet S1-2", and the first sheet S, for which the first page is printed on the front surface, is referred to as "first sheet S1-1". Further, the second sheet S, for which the fourth page is printed on the back surface, is referred to as "second sheet S2-2", and the second sheet S, for which the third page is printed on the front surface, is referred to as "second sheet S2-1". Further, the third sheet S, for which the sixth page is printed on the back surface, is referred to as "third sheet S3-2", and the third sheet S, for which the fifth page is printed on the front surface, is referred to as "third sheet S3-1". The first sheet S1-2 and the first sheet S1-1 are examples of the first sheet.

Note that the first sheet S1-2 is switched to the first sheet S1-1 at the point in time at which the conveyance direction is reversed in the first path P31, the second sheet S2-2 is switched to the second sheet S2-1 at the point in time at which the conveyance direction is reversed in the discharge path P2, and the third sheet S3-2 is switched to the third sheet S3-1 at the point in time at which the conveyance direction is reversed in the first path P31.

The conveyance control is started in accordance with the input of the printing instruction inputted into the controller 9. When the conveyance control is started for the sheet S, pieces of printing data, which correspond to respective pages to be printed, are inputted into the controller 9 in accordance with an order of the printing. The following explanation will be made by using the first data, the second data, and the third data included in the inputted printing data. The printing data includes the information which relates to the supply source of the sheet S on which the printing is to be performed and the conveyance destination of the sheet S. Further, the explanation will be made assuming that the flapper 79 is switched to the first position at the start of the conveyance control.

The first to third data include the information which indicates that the supply source is the sheet cassette 31 and the conveyance destination is the first path P31.

If the first data includes the information that the supply source is the sheet cassette 31 and the conveyance destination is the first path P31, then the controller 9 determines that the first data is the printing data for the second page. If the second data includes the information that the supply source is the sheet cassette 31 and the conveyance destination is the first path P31, then the controller 9 determines that the second data is the printing data for the fourth page. If the third data includes the information that the supply source is the sheet cassette 31 and the conveyance destination is the first path P31, then the controller 9 determines that the third data is the printing data for the sixth page. Note that if the first data includes the information that the conveyance destination is the first path P31, and the second data includes the information that the conveyance destination is the first path P31, then the controller 9 executes the high speed conveyance control in which the second sheet S2-2 is reversed in the discharge path P2.

When the conveyance control is started, the controller 9 determines the presence or absence of the sheet S supported by the sheet cassette 31 (Step S01). If the controller 9 determines in Step S01 that the sheet S supported by the sheet cassette 31 is absent (Step S01: N), the controller 9 terminates the conveyance control. The presence or absence of the sheet S supported by the sheet cassette 31 is detected by the fifth sensor 95. The controller 9 determines the presence or absence of the sheet S on the basis of the detection result obtained by the fifth sensor 95. If the conveyance control is terminated, the controller 9 can inform the image forming apparatus 1 of the information that the sheet S supported by the sheet cassette 31 is absent.

If the controller 9 determines in Step S01 that the sheet S supported by the sheet cassette 31 is present (Step S01: Y), the controller 9 confirms the printing page on which the printing is to be performed for the first time (Step S02). Specifically, it is confirmed whether or not the first data of the inputted printing data is the printing data for the second page. The first data includes the information that the supply source is the sheet cassette 31 and the conveyance destination is the first path P31. On this account, the controller 9 determines in Step S02 that the first data is the printing data for the second page (Step S02: Y). Further, as for the other printing data, it is determined that the printing data is not the printing data for the second page (Step S02: N).

If the controller 9 determines in Step S02 that the first data is the printing data for the second page, the controller 9 feeds the first sheet S1-2 supported by the sheet cassette 31 (S101). In this procedure, the controller 9 drives the first motor 81, and the controller 9 turns ON the first electromagnetic clutch 84. Accordingly, the driving force is transmitted from the first motor 81 to the first paper feed roller 32, and the first paper feed roller 32 is rotated. The first sheet S1-2, which is fed by the first paper feed roller 32, is conveyed along the paper feed path P0 toward the image forming unit 5. When the forward end of the first sheet S1-2 conveyed along the paper feed path P1 arrives at the position of the first sensor 91, then the first sensor 91 is turned ON, and the first sheet S1-2 is detected.

Figure 5A:
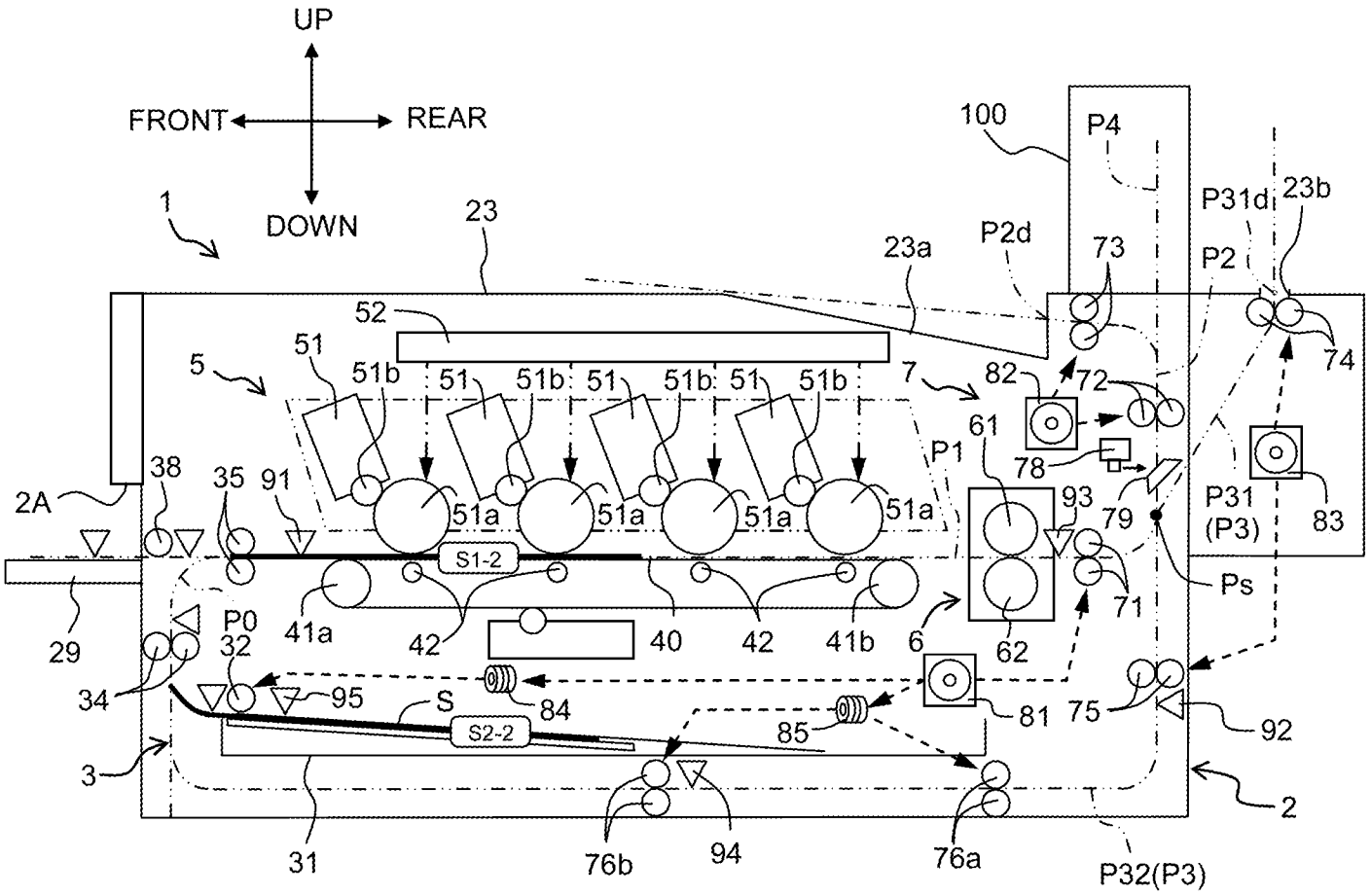

As depicted in FIG. 5A, the controller 9 controls the solenoid 78 to switch the flapper 79 from the first position to the second position before the forward end of the first sheet S1-2 arrives at the flapper 79 after feeding the first sheet S1-2 (Step S102). In this procedure, if a predetermined time elapses after turning ON the first sensor 91, the controller 9 switches the flapper 79 from the first position to the second position.

Specifically, the time is previously set until arrival of the forward end of the first sheet S1-2 at the flapper 79 after turning ON the first sensor 91. Then, the controller 9 switches the flapper 79 from the first position to the second position at the point in time at which the time elapses after turning ON the first sensor 91. Note that if the flapper 79 has been switched to the second position at the start of the conveyance control, the controller 9 maintains the flapper 79 at the second position.

The first sheet S1-2 is conveyed to the conveyance path P1 after forming the image by the image forming unit 5. If the forward end of the first sheet S1-2 conveyed along the conveyance path P1 arrives at the position of the third sensor 93, the third sensor 93 is turned ON to detect the first sheet S1-2. The first sheet S1-2, which is conveyed along the conveyance path P1, is further conveyed to the first path P31 via the branch portion Ps (Step S103).

In this procedure, if a predetermined time elapses after turning ON the third sensor 93, the controller 9 drives the third motor 83 to rotate the reverse rollers 74 and the intermediate reverse rollers 75 in the forward rotation direction. Specifically, the time is previously set until the forward end of the first sheet S1-2 arrives at the position provided before being nipped by the reverse rollers 74 by a predetermined time after turning ON the third sensor 93. Then, if the time elapses after turning ON the third sensor 93, the controller 9 rotates the reverse rollers 74 and the intermediate reverse rollers 75 in the forward rotation direction.

Figure 5B:
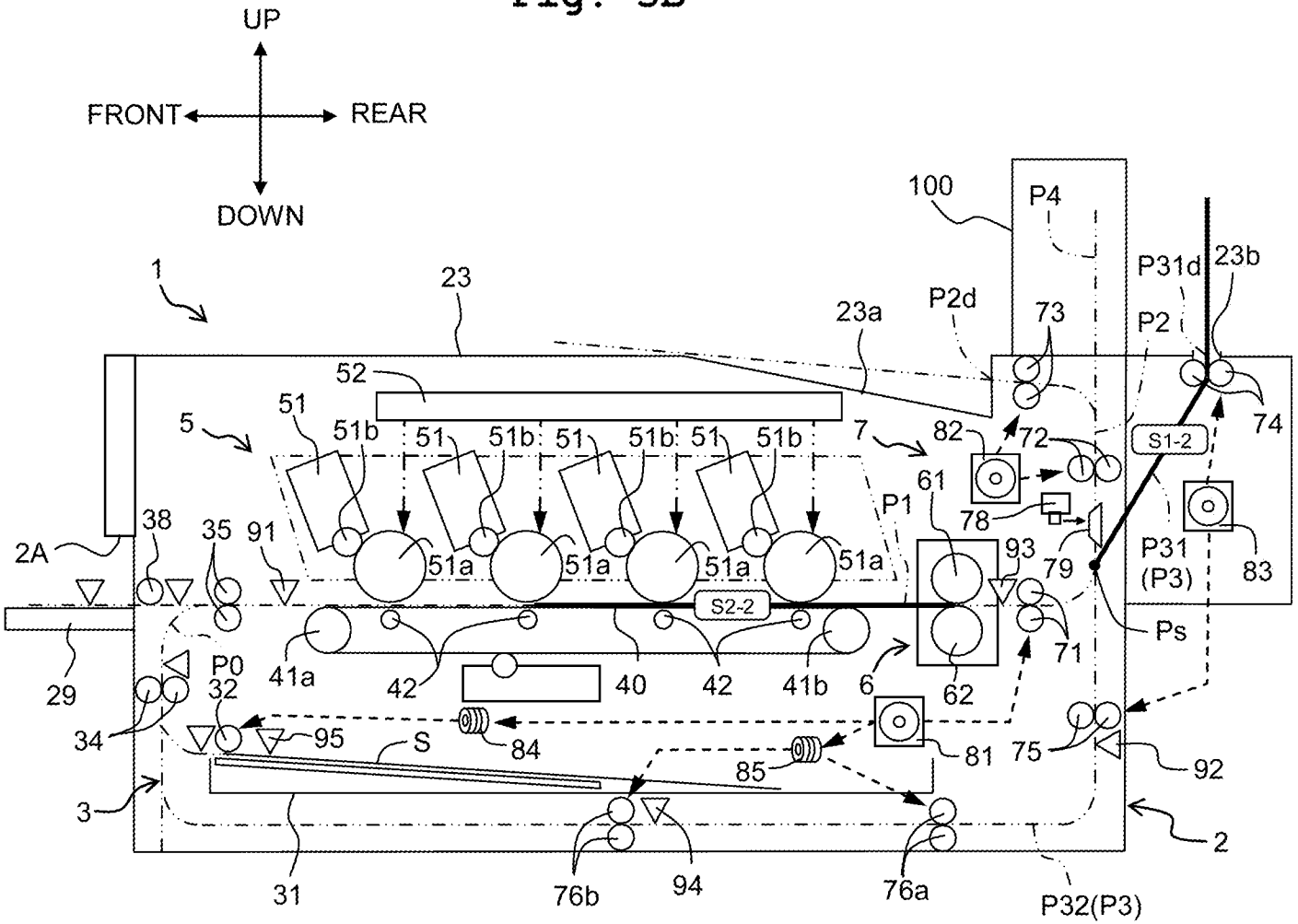

As depicted in FIG. 5B, if a predetermined time elapses after turning ON the third sensor 93 during the conveyance of the first sheet S1-2 along the first path P31, the controller 9 switches the flapper 79 from the second position to the first position (Step S104).

Specifically, the time is previously set until the back end of the first sheet S1-2 conveyed along the first path P31 passes through the branch portion Ps after turning ON the third sensor 93 so that the position of the flapper 79 can be switched. Then, if the time elapses after turning ON the third sensor 93, the controller 9 switches the flapper 79 from the second position to the first position.

In this way, the controller 9 switches the flapper 79 to the first position after the back end of the first sheet S1-2 passes through the flapper 79. Note that when the back end of the first sheet S1-2 passes through the position of the third sensor 93 during the process in which the first sheet S1-2 is conveyed along the first path P31, the third sensor 93 is turned OFF.

If the first sheet S1-2 conveyed along the first path P31 arrives at the reverse position, the controller 9 controls the driving of the third motor 83 to switch the rotation of the reverse rollers 74 and the intermediate reverse rollers 75 from the forward rotation direction to the reverse rotation direction so that the conveyance direction of the first sheet S1-2 is reversed (Step S105). In this procedure, the time is previously set until the first sheet S1-2 arrives at the reverse position after turning OFF the third sensor 93. Then, if the time elapses after turning OFF the third sensor 93, the controller 9 reverses the conveyance direction of the first sheet S1-2.

Figure 6A:
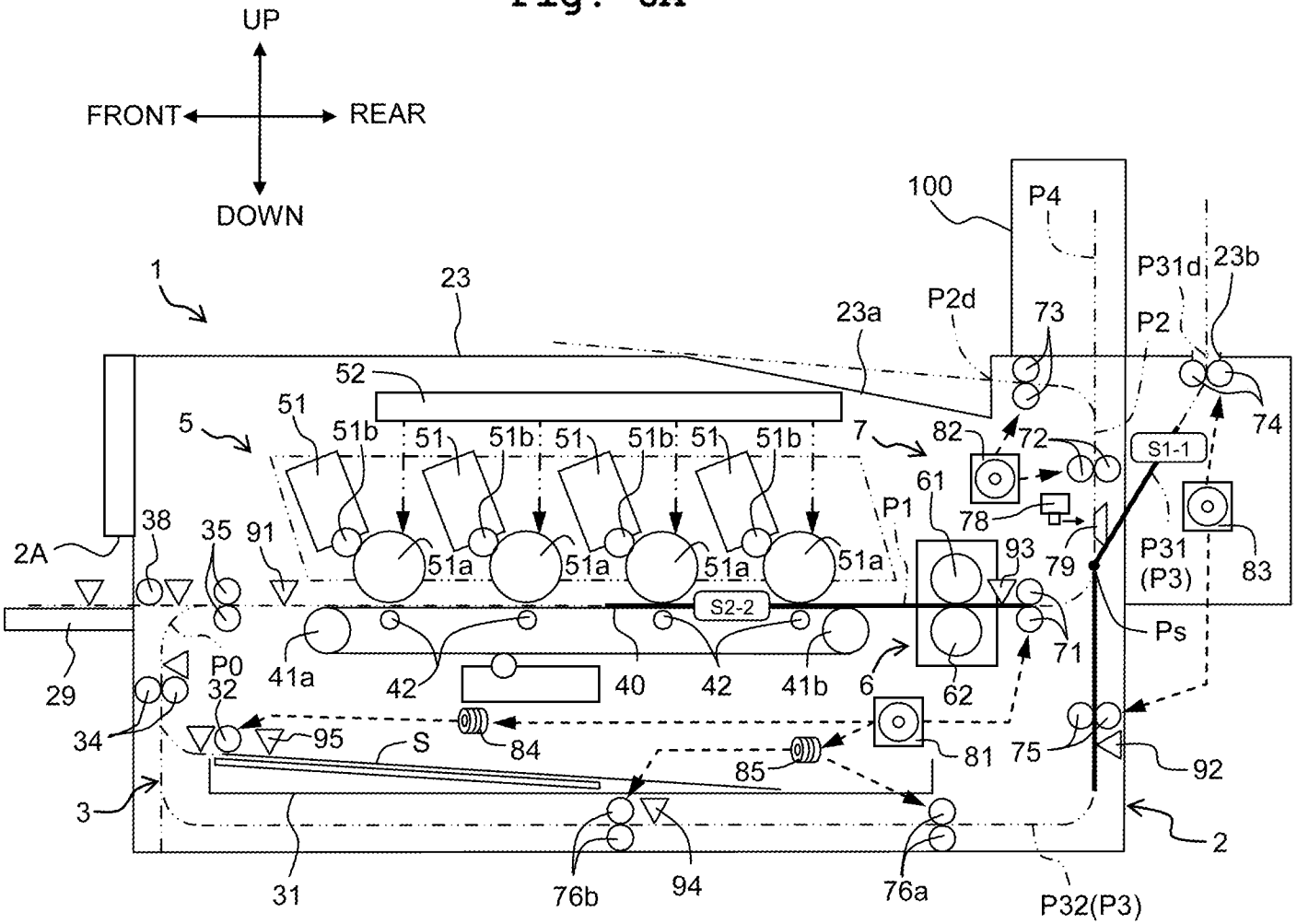

As depicted in FIG. 6A, the first sheet S1-1, which has the reversed conveyance direction, is conveyed toward the second path P32. When the forward end of the first sheet S1-1 arrives at the position of the intermediate reverse rollers 75, the first sheet S1-1 is conveyed along the second path P32 by the intermediate reverse rollers 75. Further, when the forward end of the first sheet S1-1 arrives at the position of the second sensor 92, the second sensor 92 is turned ON to detect the first sheet S1-1.

Figure 6B:
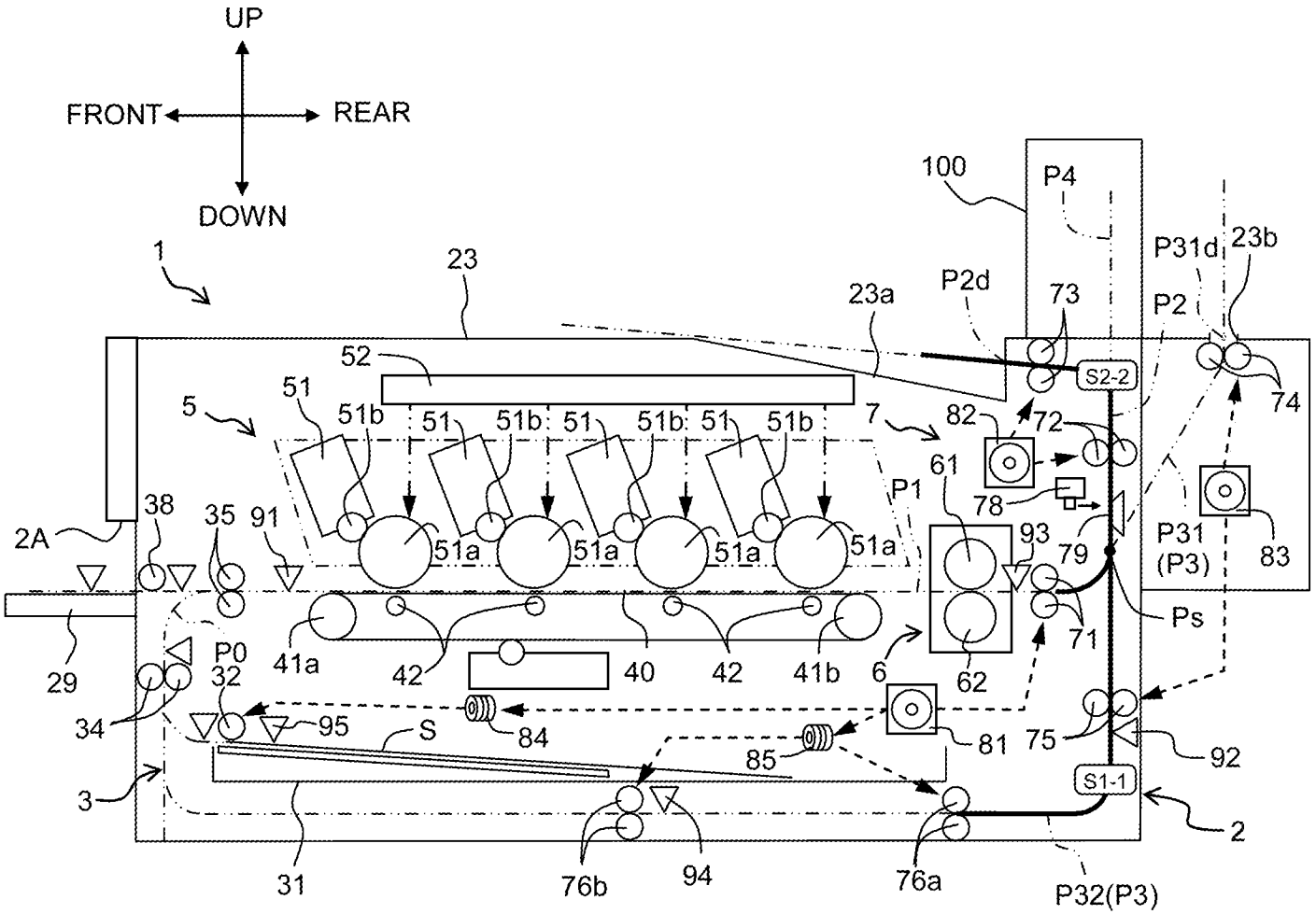

After the conveyance direction of the first sheet S1-2 is reversed in Step S105, the controller 9 determines whether or not the first sheet S1-1 has passed through the first path P31 (Step S106). In this procedure, the time is previously set until the back end of the first sheet S1-1 arrives at the branch portion Ps after turning ON the second sensor. Then, if the time elapses after turning ON the second sensor 92, the controller 9 determines that the first sheet S1-1 has passed through the first path P31 (Step S106: Y). The controller 9 repeatedly executes Step S106 (Step S106: N) until the first sheet S1-1 passes through the first path P31 as depicted in FIG. 6B.

Further, if a predetermined time elapses after reversing the conveyance direction of the first sheet S1-2 in Step S105, the controller 9 turns ON the second electromagnetic clutch 85 to transmit the driving force from the first motor 81 to the first reconveyance rollers 76*a* and the second reconveyance rollers 76*b*. Accordingly, the first reconveyance rollers 76*a* and the second reconveyance rollers 76*b* are rotated.

The controller 9 determines that the first sheet S1-1 has passed through the first path P31 in Step S106, and then the controller 9 confirms what page the printing page is in relation to the sheet S which arrives at the branch portion Ps in the next place (Step S107).

If it is determined in Step 107 that the printing page of the sheet S is neither the fourth page which is to be printed on the second sheet S2-2 to be subjected to the high speed conveyance control nor the odd number page (for example, the first page to be printed on the first sheet S1-1) which is to be printed on the front surface of the sheet S, the controller 9 controls the solenoid 78 to switch the flapper 79 from the first position to the second position (Step S108). Accordingly, the sheet S, which arrives at the branch portion Ps in the next place, can be guided to the first path P31.

If it is determined in Step 107 that the printing page of the sheet S is the fourth page which is to be printed on the second sheet S2-2 to be subjected to the high speed conveyance control or the odd number page which is to be printed on the front surface of the sheet S, the controller 9 proceeds to Step S109 while maintaining the position of the flapper 79 at the first position without switching the position of the flapper 79. The second sheet S2-2, which is subjected to the high speed conveyance control, is reversed in the discharge path P2. The sheet S, for which the odd number page is printed on the front surface, is discharged to the discharge tray 23*a*. On this account, the sheets S can be guided to the discharge path P2 by maintaining the flapper 79 at the first position.

Figure 7A:
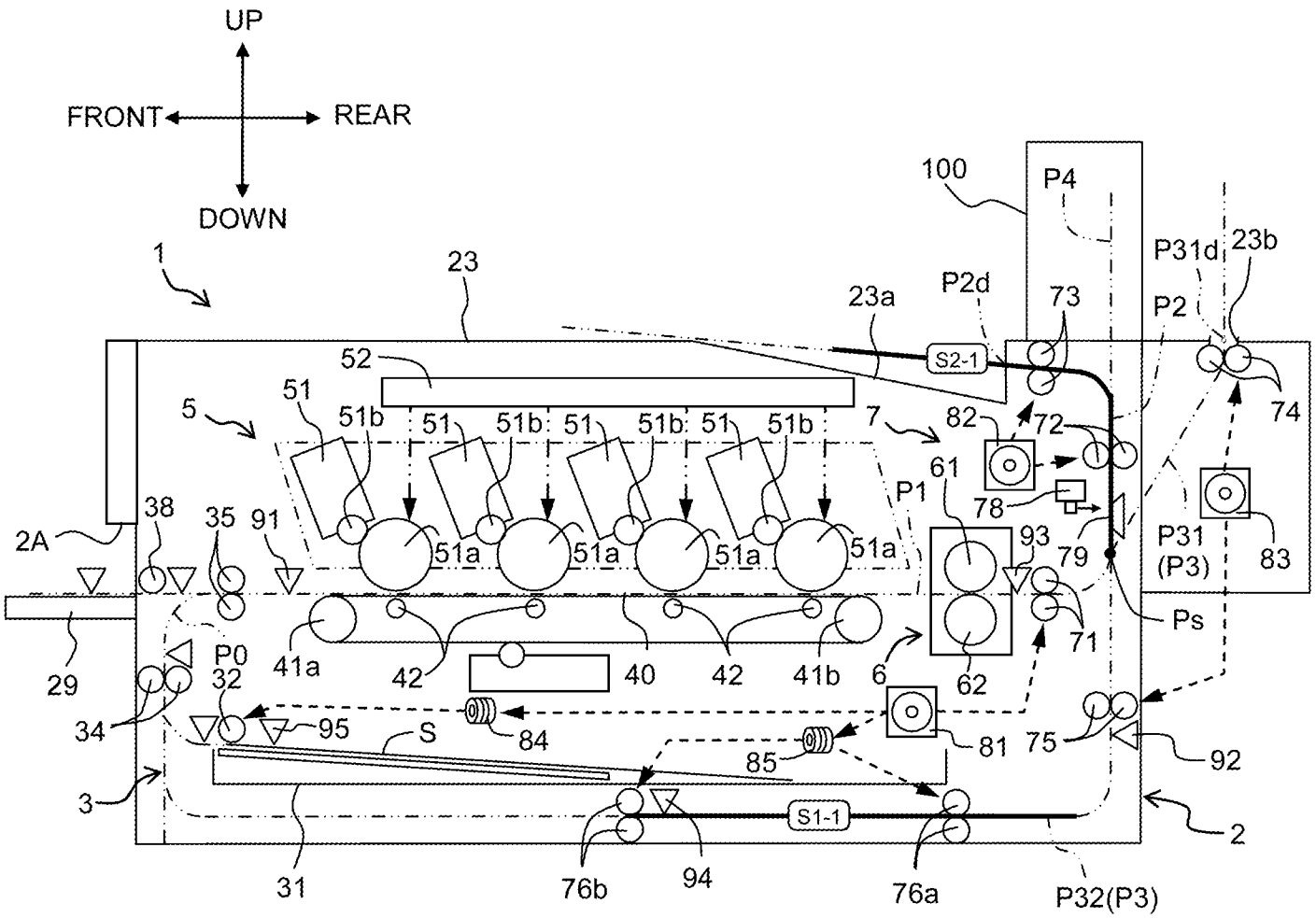

The first sheet S1-1, which has passed through the first path P31, is conveyed along the second path P32 while being interposed by the first reconveyance rollers 76*a*. When the forward end of the first sheet S1-1 conveyed by the first reconveyance rollers 76*a* arrives at the position of the fourth sensor 94, the fourth sensor 94 is turned ON to detect the first sheet S1-1. As depicted in FIG. 7A, the first sheet S1-1 is further conveyed by the reconveyance rollers 76*a*, and the first sheet S1-1 is interposed by the second reconveyance rollers 76*b*.

The controller 9 determines in Step S106 that the first sheet S1-1 has passed through the first path P31, and then the controller 9 determines whether or not the first sheet S1-1 arrives at the second path P32 (Step S109). In this procedure, if a predetermined time elapses after turning ON the fourth sensor 94, the controller 9 determines that the first sheet S1-1 has arrived at the second path P32 (Step S109: Y). Further, the controller 9 repeatedly executes Step S109 until the predetermined time elapses after turning ON the fourth sensor 94 (Step S109: N).

If it is determined that the first sheet S1-1 has arrived at the second path P32, then the controller 9 turns OFF the second electromagnetic clutch 85 to shut off the transmission of the driving force from the first motor 81 to the first reconveyance rollers 76*a* and the second reconveyance rollers 76*b*. Accordingly, the driving is stopped for the first reconveyance rollers 76*a* and the second reconveyance rollers 76*b* in a state in which the first reconveyance rollers 76*a* and the second reconveyance rollers 76*b* interpose the first sheet S1-1. Accordingly, the conveyance of the first sheet S1-1 is stopped in the second path P32 (Step S110).

The controller 9 confirms the printing page in Step S02, and then the controller 9 confirms the printing page on which the printing is to be performed next to the second page (Step S03). Specifically, it is confirmed whether or not the second data of the inputted printing data is the printing data for the fourth page. The second data includes the information that the supply source is the sheet cassette 31 and the conveyance destination is the first path 31. Therefore, the controller 9 determines in Step S03 that the second data is the printing data for the fourth page (Step S03: fourth page).

Further, the controller 9 determines that the third data, which is the other printing data, is not the printing data for the fourth page (Step S03: ≠fourth page). Further, the third data includes the information that the supply source is the sheet cassette 31 and the conveyance destination is the first path P31, and hence the controller 9 determines that the third data is the printing data for the sixth page which is to be printed next to the fourth page.

If the controller 9 determines in Step S03 that the second data is the printing data for the fourth page, the controller 9 determines whether or not a predetermined time elapses after the first sensor 91 is turned ON in accordance with the arrival of the forward end of the first sheet S1-2 fed in Step S101 at the position of the first sensor 91 (Step S201). The controller 9 repeatedly executes Step S201 until the predetermined time elapses (Step S202: N). If it is determined that the predetermined time has elapsed (Step S201: Y), the controller 9 executes Step S202.

As depicted in FIG. 5A, in Step S202, the second sheet S2-2, which is fed next to the first sheet S1-2, is fed by the controller 9 from the sheet cassette 31 to the paper feed path P0. In this procedure, the controller 9 feeds the second sheet S2-2 so that the conveyance space between the first sheet S1-2 and the second sheet S2-2 is provided or widened by a predetermined distance. In this procedure, the predetermined distance is such a distance that the forward end of the second sheet S2-2 is nipped by the heating roller 61 and the pressurizing roller 62 when the back end of the first sheet S1-2 passes through the flapper 79.

In other words, the predetermined time, which elapses after turning ON the first sensor 91 in Step S201, is set to such a time that the conveyance space between the first sheet S1-2 and the second sheet S2-2 is provided or widened by the predetermined distance described above.

The controller 9 executes the paper feed of the second sheet S2-2 in Step S202, and then the controller 9 confirms whether or not any delay occurs in the paper feed of the second sheet S2-2 (Step S203). Whether or not any delay occurs in the paper feed of the second sheet S2-2 is determined depending on whether or not the first sensor 91 has already detected the forward end of the second sheet S2-2 when the second sensor 92 detects the forward end of the first sheet S1-1 after reversing the first sheet S1-2 in the first path P31 by switching the rotation direction of the reverse rollers 74 from the forward rotation direction to the reverse rotation direction.

Further, the controller 9 determines whether the high speed conveyance control is executed to convey the second sheet S2-2 to the discharge path P2 or the conveyance switching control is executed to convey the second sheet S2-2 to the first path P31, depending on whether or not any delay occurs in the paper feed of the second sheet S2-2. In this way, it is possible to accurately determine what control is to be executed, by determining whether the high speed conveyance control is executed or the conveyance switching control is executed, depending on whether or not any delay occurs in the paper feed of the second sheet S2-2.

As depicted in FIG. 6A, the controller 9 determines that any delay does not occur (Step S203: N) if the first sensor 91 has already detected the forward end of the second sheet S2-2 when the second sensor 92 detects the forward end of the first sheet S1-1 to confirm whether or not any delay occurs in the paper feed of the second sheet S2-2 in Step S203.

In FIG. 6A, such a state is given that the forward end of the second sheet S2-2 has passed through the first sensor 91 to further arrive at the position of the third sensor 93. The forward end of the second sheet S2-2 arrives at the position of the third sensor 93, and thus the third sensor 93 is turned ON. Further, the first sheet S1-1 is conveyed from the first path P31 toward the second path P32, and the first sheet S1-1 does not have passed through the first path P31 yet.

<High Speed Conveyance Control>

If it is determined in Step S203 that no delay occurs in the paper feed of the second sheet S2-2, the controller 9 performs the high speed conveyance control in which the second sheet S2-2 is conveyed to the discharge path P2 so that the second sheet S2-2 is reversed (Steps S211 to S213).

In the high speed conveyance control, if a predetermined time elapses after turning ON the third sensor 93 in accordance with the detection of the second sheet S2-2, the controller 9 drives the second motor 82 to rotate the discharge rollers 73 and the intermediate discharge rollers 72 in the forward rotation direction. Specifically, the time is previously set until the forward end of the second sheet S2-2 arrives at the intermediate discharge rollers 72 after turning ON the third sensor 93. Then, if the time elapses after turning ON the third sensor 93, the controller 9 rotates the discharge rollers 73 and the intermediate discharge rollers 72 in the forward rotation direction.

Further, as depicted in FIG. 6A, the flapper 79 is switched from the second position to the first position after the first sheet S1-2 before being reversed passes through the branch portion Ps in Step S104. The flapper 79 is maintained at the first position as well even when the forward end of the second sheet S2-2 arrives at the position of the third sensor 93. Therefore, if the second sheet S2-2 is further conveyed from the position of the arrival at the third sensor 93, then the second sheet S2-2 is guided to the discharge path P2 by the flapper 79 disposed at the first position as depicted in FIG. 6B, and the second sheet S2-2 is conveyed along the discharge path P2 by the intermediate discharge rollers 72 and the discharge rollers 73 (Step S211). In this way, the controller 9 positions the flapper 79 at the first position if the second sheet S2-2 is conveyed to the discharge path P2.

Further, in the high speed conveyance control to be executed when no delay occurs in the paper feed of the second sheet S2-2, the back end of the first sheet S1-1 conveyed from the first path P31 to the second path P32 does not pass through the flapper 79, when the forward end of the second sheet S2-2 arrives at the position of the third sensor 93 disposed before the flapper 79.

In such a situation, the second sheet S2-2 is conveyed to the discharge path P2. Therefore, the flapper 79, which is switched to have the first position in Step S104, is maintained at the first position until the forward end of the second sheet S2-2 arrives at the flapper 79. Accordingly, the second sheet S2-2 can be guided to the discharge path P2, while suppressing any unnecessary switching of the flapper 79. Note that when the back end of the second sheet S2-2 passes through the position of the third sensor 93 during the process in which the second sheet S2-2 is conveyed along the discharge path P2, the third sensor is turned OFF.

When the second sheet S2-2, which is conveyed along the discharge path P2, arrives at the reverse position, the controller 9 controls the driving of the second motor 82 to switch the rotation of the discharge rollers 73 and the intermediate discharge rollers 72 from the forward rotation direction to the reverse rotation direction so that the conveyance direction of the second sheet S2-2 is reversed (Step S212). In this procedure, the time is previously set until the second sheet S2-2 arrives at the reverse position after turning OFF the third sensor 93. Then, if the time elapses after turning OFF the third sensor 93, the controller 9 reverses the conveyance direction of the second sheet S2-2.

Figure 7B:
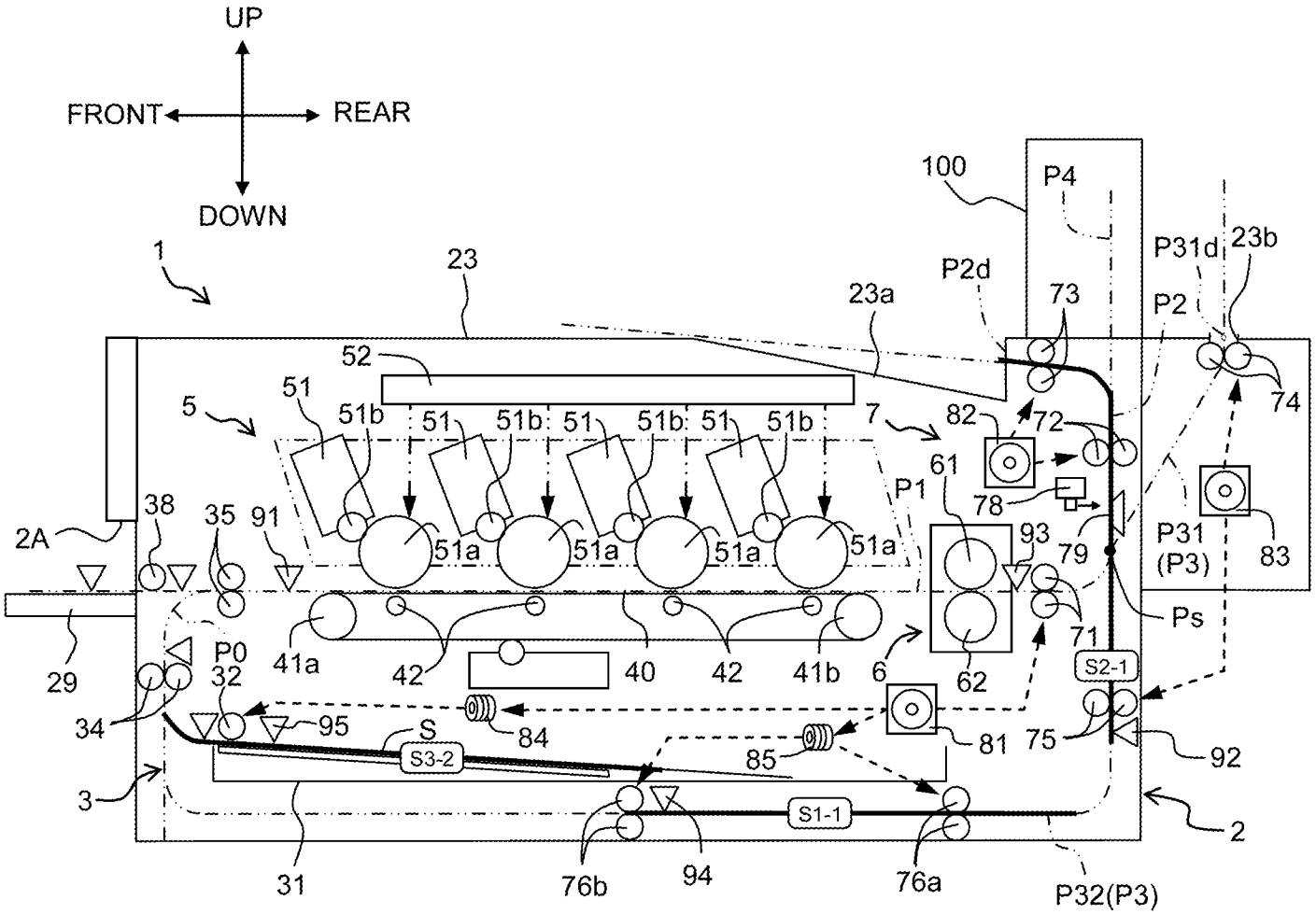

As depicted in FIG. 7A, the second sheet S2-1, which has the reversed conveyance direction, is conveyed toward the second path P32. As depicted in FIG. 7B, when the forward end of the second sheet S2-1 arrives at the position of the intermediate reverse rollers 75, the second sheet S2-1 is conveyed along the second path P32 by means of the intermediate reverse rollers 75. Further, when the forward end of the second sheet S2-1 arrives at the position of the second sensor 92, the second sensor 92 is turned ON to detect the second sheet S2-1.

Figure 8:
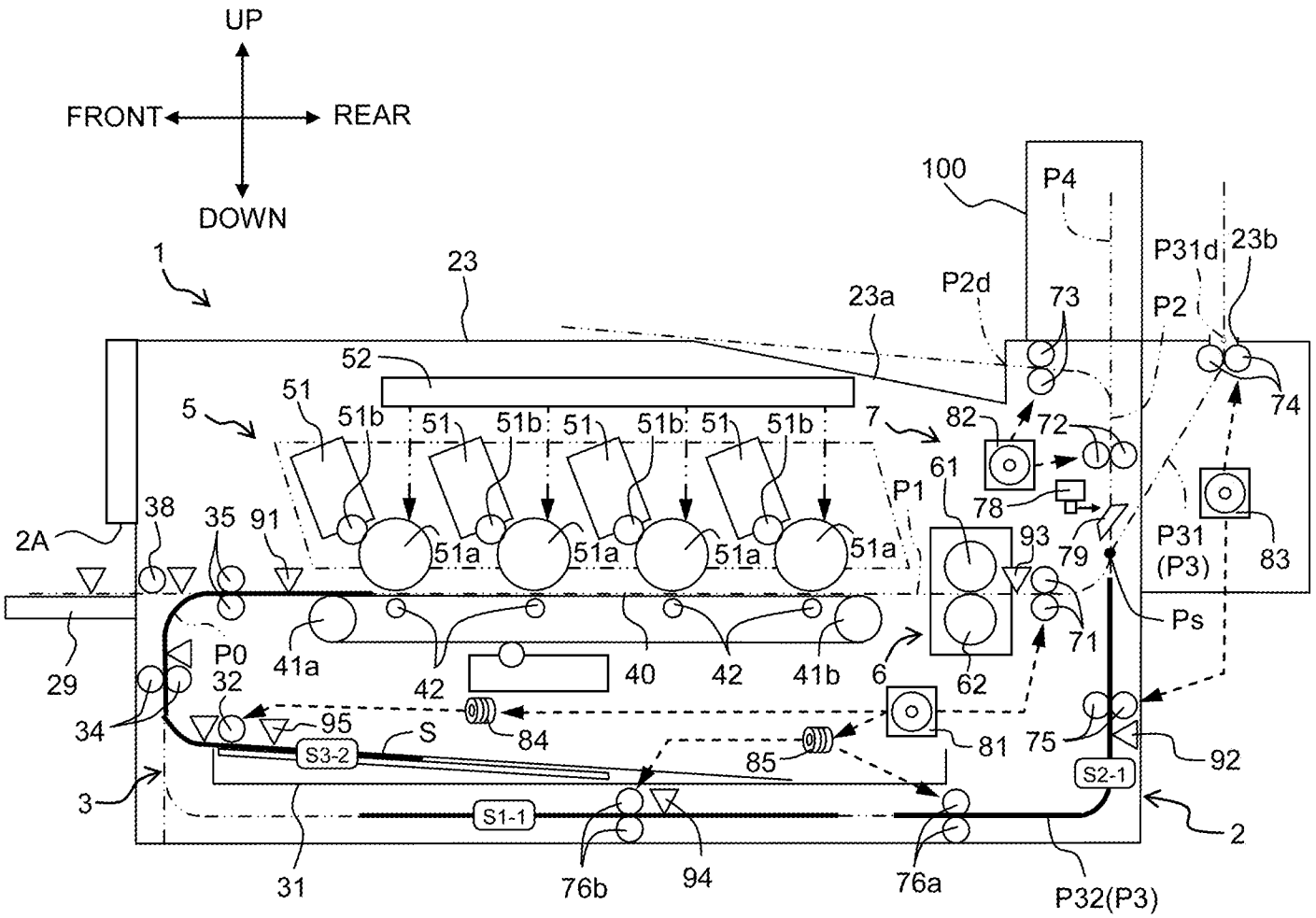
FIG. 8 depicts a sectional view taken along the center line of the image forming apparatus, illustrating a state in which the conveyance of the first sheet is restarted in the second path, the second sheet is conveyed along the second path, and the fed third sheet is conveyed along a paper feed path.

After the conveyance direction of the second sheet S2-2 is reversed in Step S212, the controller 9 determines whether or not the second sheet S2-1 has passed through the discharge path P2 (Step S213). In this procedure, the time is previously set until the back end of the second sheet S2-1 arrives at the branch portion Ps after turning ON the second sensor 92. Then, if the time elapses after turning ON the second sensor 92, the controller 9 determines that the second sheet S2-1 has passed through the discharge path P2 (Step S213: Y). As depicted in FIG. 8, the controller 9 repeatedly executes Step S213 until the second sheet S2-1 passes through the discharge path P2 (Step S213: N).

If it is determined that the second sheet S2-1 has passed through the discharge path P2, the controller 9 executes the process which is equivalent to or the same as the process of Step S108 to switch the flapper 79 from the first position to the second position. Accordingly, the third sheet S3-2, which will arrive at the branch portion Ps in the next place, can be guided to the first path P31.

Figure 9A:
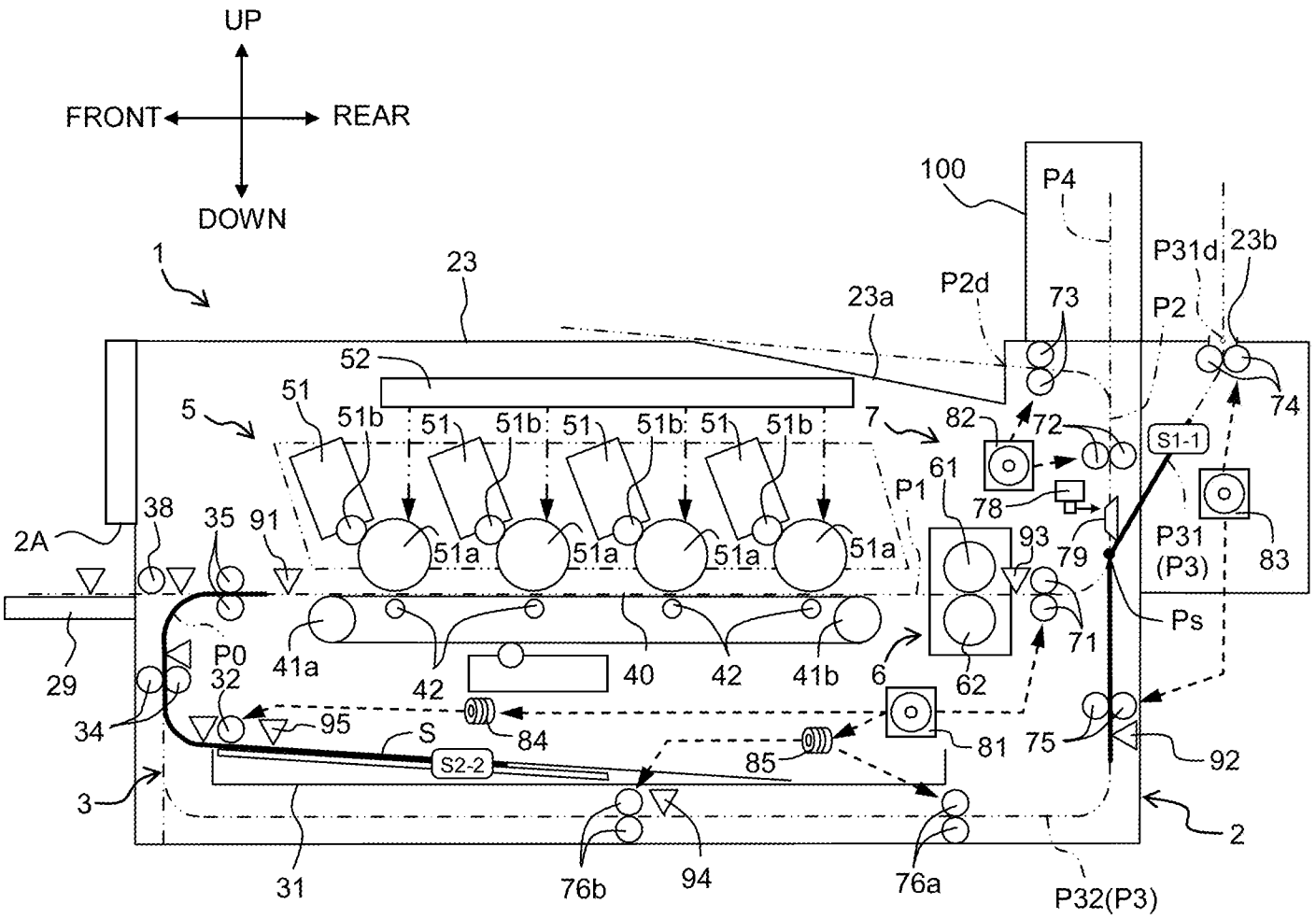

As depicted in FIG. 9A, the controller 9 determines that any delay occurs (Step S203: Y) if the first sensor 91 does not detect the forward end of the second sheet S2-2 yet, when the second sensor 92 detects the forward end of the first sheet S1-1 in Step S203 to confirm whether or not any delay occurs in the paper feed of the second sheet S2-2. Note that the delay of the paper feed of the second sheet S2-2 may arise due to the occurrence of any mistake in the paper feed, for example, such that any mistake occurs in the feeding of the second sheet S2-2 from the sheet cassette 31, for example, when the paper feed of the second sheet S2-2 is started in Step S202.

Further, when any delay occurs in the paper feed of the second sheet S2-2, then the first sheet S1-1, which is conveyed toward the second path P32, has the back end which has passed through the first path P31, for example, at the point in time at which the forward end of the second sheet S2-2 arrives at the flapper 9. On this account, the first path P31 is in the vacant state. Therefore, if it is determined that any delay occurs in the paper feed of the second sheet S2-2 in Step S203, the controller 9 performs the conveyance switching control so that the second sheet S2-2 is conveyed to the first path P31 to reverse the second sheet S2-2 (Steps S221 to S226).

<Conveyance Switching Control>

Figure 9B:
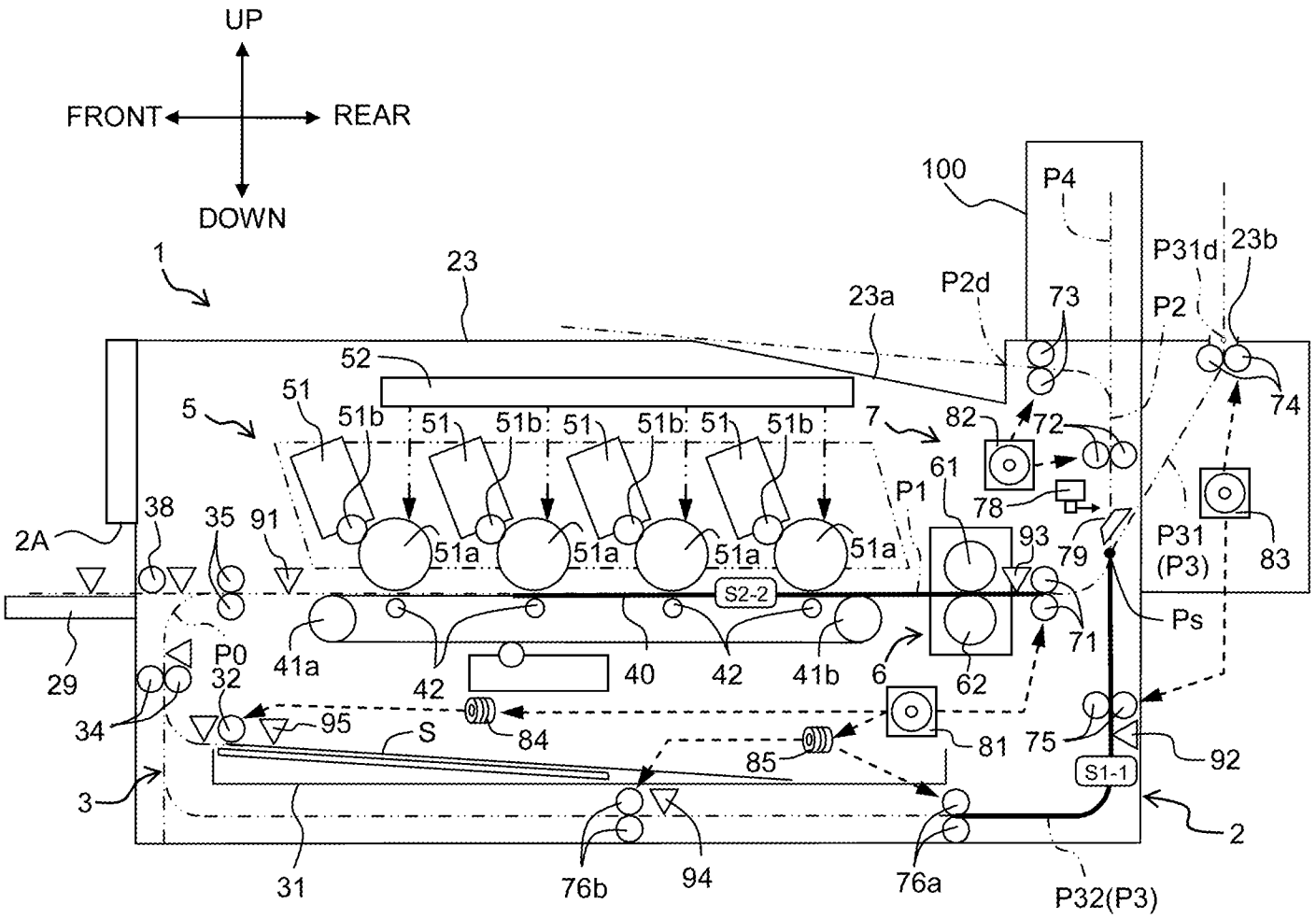

In the conveyance switching control, the controller 9 determines whether or not the first sheet S1-1 has passed through the first path P31 (Step S221). In this procedure, the time is previously set until the back end of the first sheet S1-1 arrives at the branch portion Ps after turning ON the second sensor 92. Then, if the time elapses after turning ON the second sensor 92, the controller 9 determines that the first sheet S1-1 has passed through the first path P31 (Step S221: Y). The controller 9 repeatedly executes Step S106 (Step S221: N) until the first sheet S1-1 passes through the first path P31 as depicted in FIG. 9B.

If it is determined in Step S221 that the first sheet S1-1 has passed through the first path P31, the controller 9 controls the solenoid 78 to switch the flapper 79 from the first position to the second position (Step S222).

In this way, in the conveyance switching control, the flapper 79 is switched to the second position after the first sheet S1-1 passes through the first path P31. When the first sheet S1-2 is reversed in the first path P31 so that the reversed first sheet S1-1 is conveyed toward the second path P32, the flapper 79 is switched to the first position. Therefore, it is possible to stabilize the conveyance of the first sheet S1-1.

The second sheet S2-2, which is fed to the paper feed path P0, is conveyed to the conveyance path P1 after forming the image in the image forming unit 5. When the forward end of the second sheet S2-2 conveyed along the conveyance path P1 arrives at the position of the third sensor 93, the third sensor 93 is turned ON to detect the second sheet S2-2. As depicted in FIG. 9B, at the point in time at which the forward end of the second sheet S2-2 conveyed along the conveyance path P1 passes through the position of the third sensor 93 and the forward end arrives at the position before the flapper 79, the back end of the first sheet S1-1 conveyed toward the second path P32 has passed through the first path P31, and the flapper 79 has been switched to the second position.

Therefore, the second sheet S2-2, which is conveyed along the conveyance path P1, is guided to the first path P31 via the branch portion Ps by means of the flapper 79 disposed at the second position, and the second sheet S2-2 is conveyed along the first path P31 by means of the post-fixation rollers 71 (Step S223). In this way, when the second sheet S2-2 is conveyed to the first path P31, the controller 9 positions the flapper 79 at the second position.

In this procedure, the controller 9 controls the third motor 83 after the back end of the first sheet S1-1 has passed through the intermediate reverse rollers 75 so that the reverse rollers 74 and the intermediate reverse rollers 75, which are rotated in the reverse rotation direction, are stopped. After that, if a predetermined time elapses after turning ON the third sensor 93, the third motor 83 is driven to rotate the reverse rollers 74 and the intermediate reverse rollers 75 in the forward rotation direction.

Specifically, the time is previously set until the forward end of the second sheet S2-2 arrives at the reverse rollers 74 after turning ON the third sensor 93. Then, if the time elapses after turning ON the third sensor 93, the controller 9 rotates the reverse rollers 74 and the intermediate reverse rollers 75 in the forward rotation direction. Note that the timing, at which the predetermined time elapses after turning ON the third sensor 93, is set to be after the timing at which the back end of the first sheet S1-1 passes through the intermediate reverse rollers 75 and the reverse rollers 74 and the intermediate reverse rollers 75 are stopped.

Figure 10A:
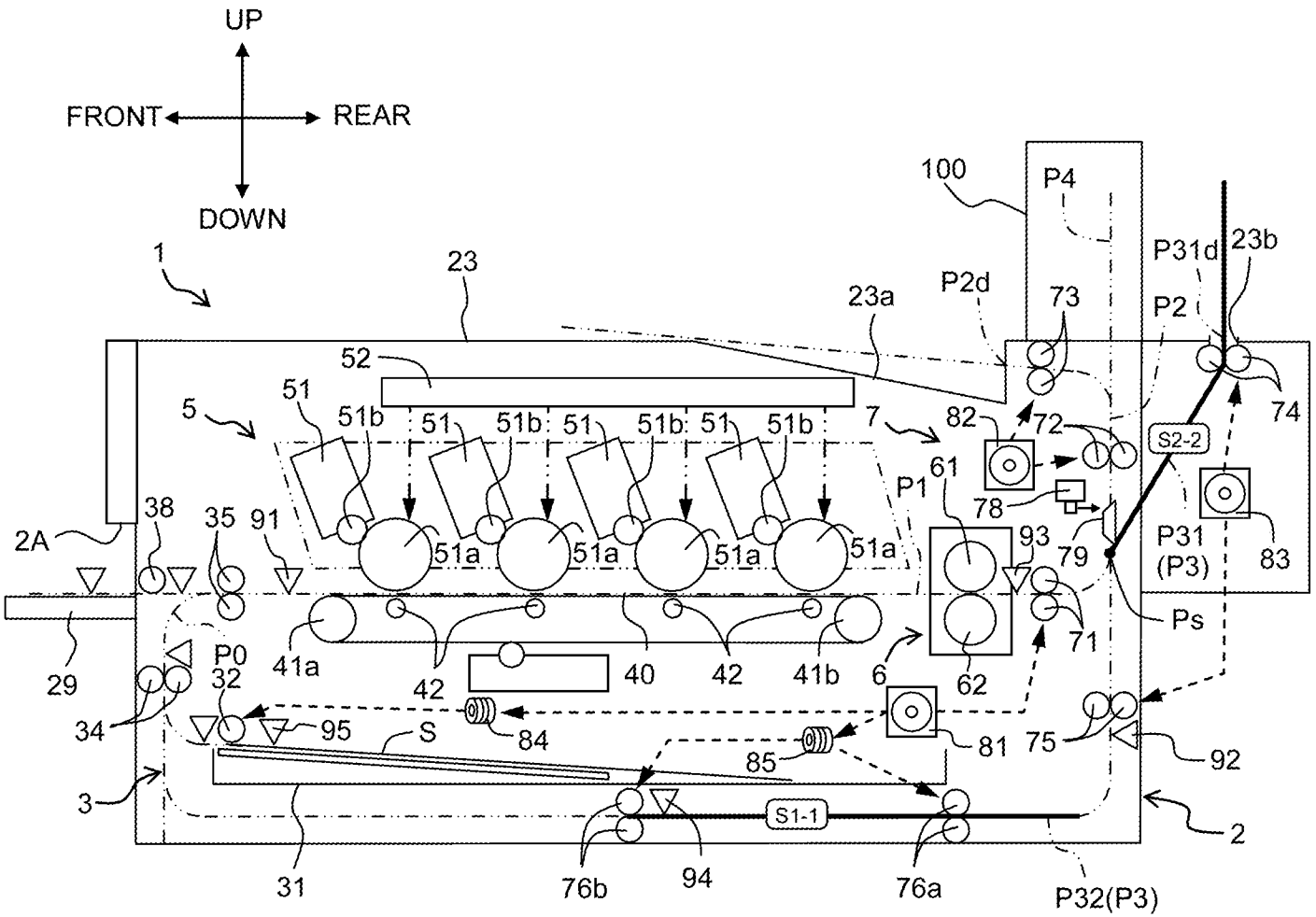

As depicted in FIG. 10A, if a predetermined time elapses after the back end of the second sheet S2-2 passes through the third sensor 93 and the third sensor 93 is turned OFF, then the controller 9 switches the flapper 79 from the second position to the first position (Step S224). Note that in FIG. 10A, the conveyance is stopped in a state in which the first sheet S1-1 is interposed by the second reconveyance rollers 76*b* in the second path P32.

Specifically, the time is previously set until the back end of the second sheet S2-2 conveyed along the first path P31 passes through the branch portion Ps so that the position of the flapper 79 can be switched after turning OFF the third sensor. Then, if the time elapses after turning OFF the third sensor 93, the controller 9 switches the flapper 79 from the second position to the first position.

When the second sheet S2-2 conveyed along the first path P31 arrives at the reverse position, the controller 9 controls the driving of the third motor 83 to switch the rotation of the reverse rollers 74 and the intermediate reverse rollers 75 from the forward rotation direction to the reverse rotation direction so that the conveyance direction of the second sheet S2-2 is reversed (Step S225). In this procedure, the time is previously set until the second sheet S2-2 arrives at the reverse position after turning OFF the third sensor 93. Then, if the time elapses after turning OFF the third sensor 93, the controller 9 reverses the conveyance direction of the second sheet S2-2.

Figure 10B:
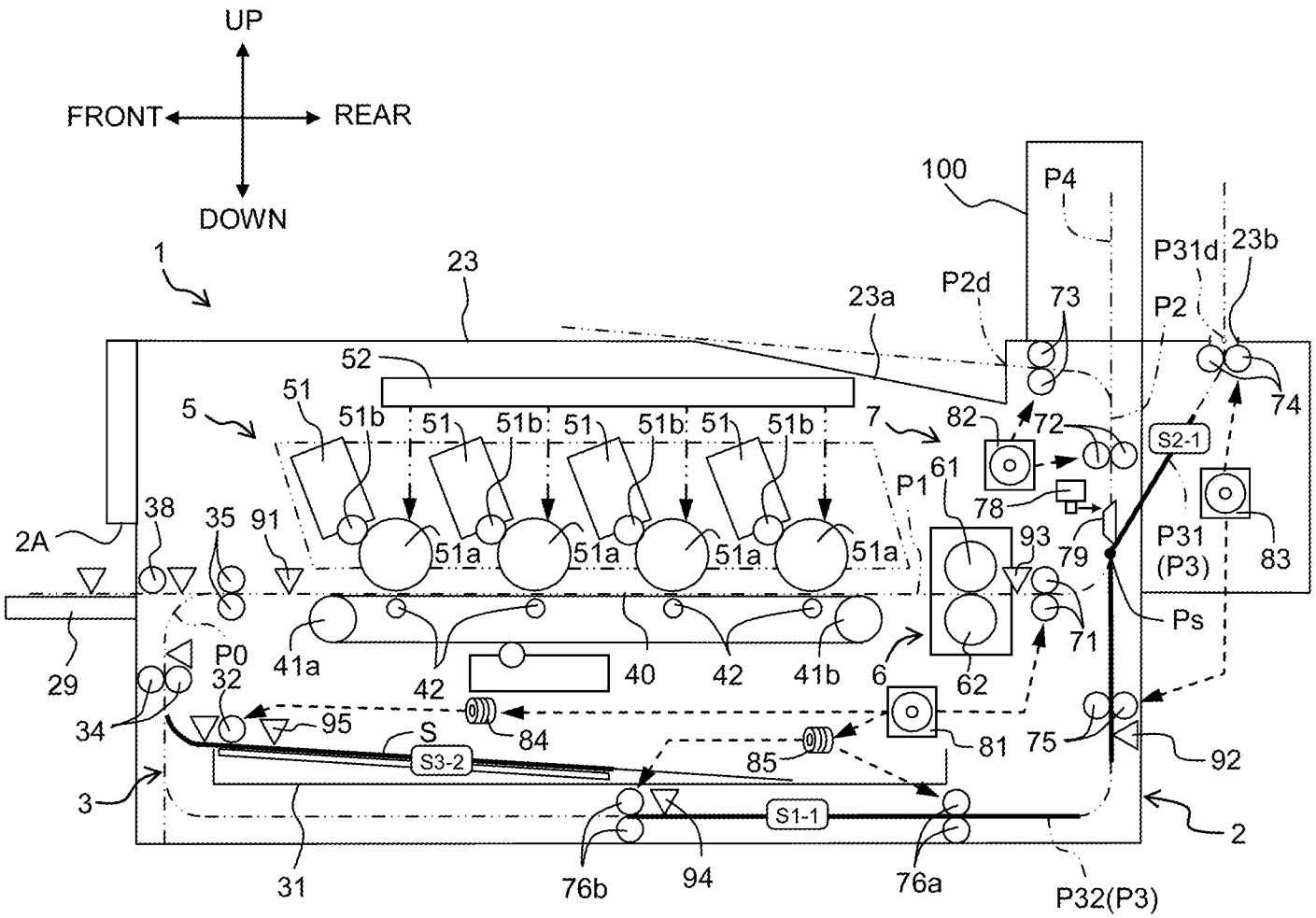

As depicted in FIG. 10B, the second sheet S2-1, which has the reversed conveyance direction, is conveyed toward the second path P32. When the forward end of the second sheet S2-1 arrives at the position of the intermediate reverse rollers 75, the second sheet S2-1 is conveyed along the second path P32 by means of the intermediate reverse rollers 75. Further, when the forward end of the second sheet S2-1 arrives at the position of the second sensor 92, the second sensor 92 is turned ON to detect the second sheet S2-1.

Figure 11:
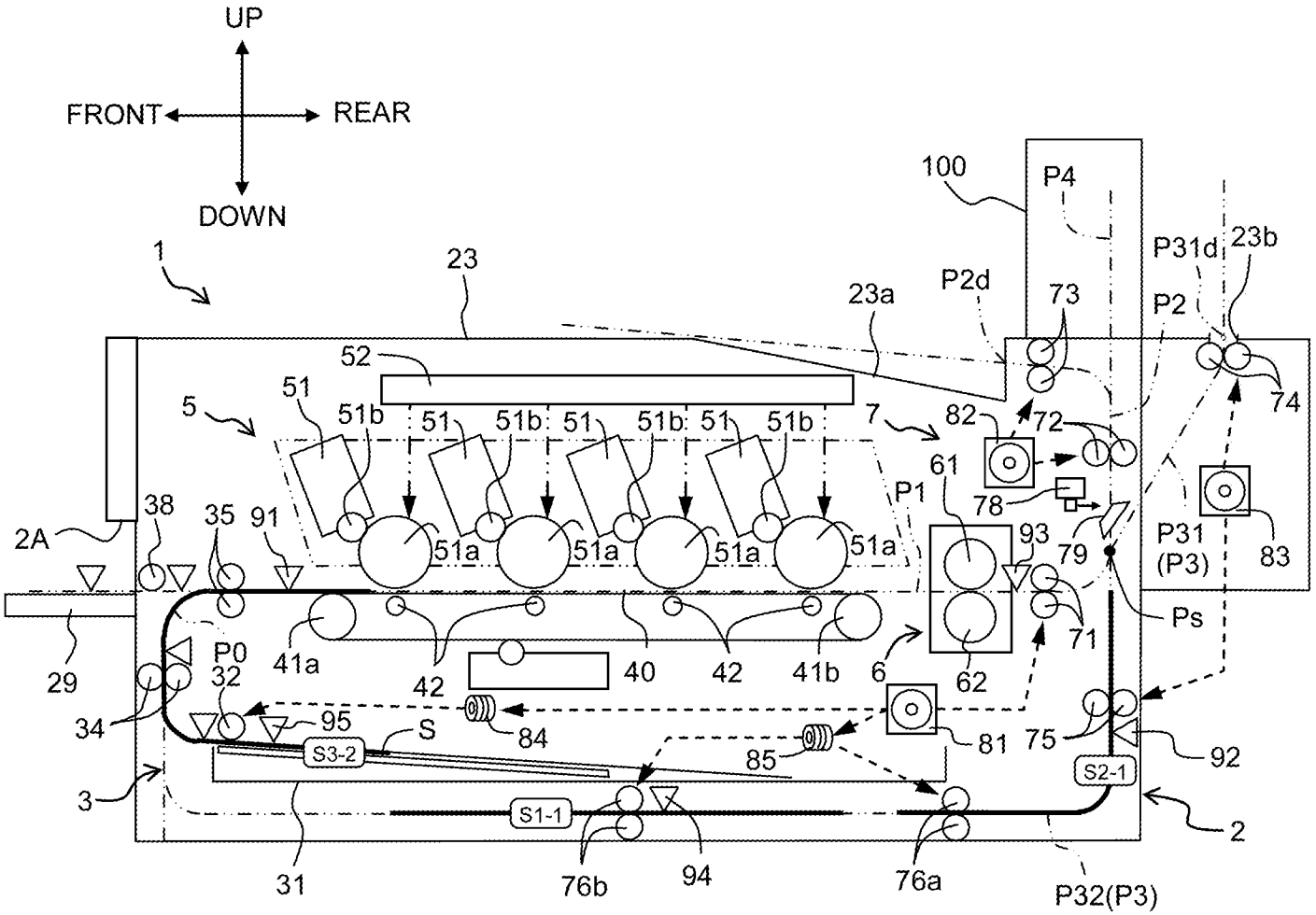
FIG. 11 depicts a sectional view taken along the center line of the image forming apparatus, illustrating a state in which the paper feed of the second sheet is delayed, the conveyance of the first sheet is restarted in the second path, the second sheet is conveyed along the second path, and the fed third sheet is conveyed along the paper feed path.

The controller 9 reverses the conveyance direction of the second sheet S2-2 in Step S225, and then the controller 9 determines whether or not the second sheet S2-1 has passed through the first path P31 (Step S226). In this procedure, the time is previously set until the back end of the second sheet S2-1 arrives at the branch portion Ps after turning ON the second sensor 92. Then, if the time elapses after turning ON the second sensor 92, the controller 9 determines that the second sheet S2-1 has passed through the first path P31 (Step S226: Y). The controller 9 repeatedly executes Step S226 (Step S226: N) until the second sheet S2-1 passes through the first path P31 as depicted in FIG. 11.

If the controller 9 determines that the second sheet S2-1 has passed through the first path P31, the controller 9 executes the process which is the same as or equivalent to the process of Step S108 to switch the flapper 79 from the first position to the second position. Accordingly, the third sheet S3-2, which will arrive at the branch portion Ps in the next place, can be guided to the first path P31.

The controller 9 determines whether or not a predetermined time elapses (Step S301) after the second sheet 2-2 is reversed in the first path P31 or the discharge path P2 after determining that the third data is not the printing data for the fourth page but the printing data for the sixth page when the printing page is confirmed in Step S03. The controller 9 repeatedly executes Step S301 until the predetermined time elapses (Step S301: N). If it is determined that the predetermined time has elapsed (Step S301: Y), the controller 9 executes Step S302.

As depicted in FIGS. 7B and 10B, in Step S302, the controller 9 feeds the third sheet S3-2 to be fed next to the second sheet S2-2 from the sheet cassette 31 to the paper feed path P0. In this procedure, the controller 9 feeds the third sheet S3-2 so that the forward end of the third sheet S3-2 arrives at the flapper 79 when the back end of the reversed second sheet S2-1 has passed through the first path P31.

In other words, the predetermined time, which elapses after the second sheet S2-2 is inverted in Step S301, is the time until the back end of the second sheet S2-1 passes through the first path P31 and the forward end of the third sheet S3-2 arrives at the flapper 79 after the second sheet S2-2 is reversed.

In this way, the third sheet S3-2 is fed on the basis of the fact that the second sheet S2-2 is reversed in the first path P31 or the discharge path P2 and the reversed second sheet S2-1 is conveyed toward the second path P32.

The controller 9 executes the process which is the same as or equivalent to the process of Step S103 after feeding the third sheet S3-2. Accordingly, the image is formed by the image forming unit 5 on the fed third sheet S3-2, and then the fed third sheet S3-2 is conveyed to the first path P31 via the conveyance path P1.

The controller 9 stops the conveyance of the first sheet S1-1 in the second path P32 in Step S110, and then the controller 9 determines whether or not the third sheet S3-2 is fed (Step S111). The controller 9 repeatedly executes Step S111 (Step S111: N) until the third sheet S3-2 is fed. When the third sheet S3-2 is fed in Step S302, then the controller 9 determines that the feed of the third sheet S3-2 has been performed (Step S111: Y), and the controller 9 executes Step S112.

As depicted in FIGS. 8 and 11, the controller 9 turns ON the second electromagnetic clutch 85 in Step S112 to transmit the driving force from the first motor 81 to the first reconveyance rollers 76*a* and the second reconveyance rollers 76*b* so that the driving of the first reconveyance rollers 76*a* and the second reconveyance rollers 76*b* is restarted. Accordingly, the conveyance of the first sheet S1-1 is restarted in the second path P32, the conveyance of the first sheet S1-1 having been stopped.

In this way, the controller 9 restarts the driving of the first reconveyance rollers 76*a* and the second reconveyance rollers 76*b*, taking the opportunity of the paper feed of the third sheet S3-2, i.e., on the basis of the fact that the second sheet S2-1, which has been reversed in the first path P31 or the discharge path P2, is conveyed toward the second path P32.

In the image forming apparatus 1, when the first sheet S1-1 and the second sheet S2-1 are conveyed, then the conveyance of the first sheet S1-1 is once stopped, and the conveyance of the first sheet S1-1 is restarted on the basis of the conveyance of the second sheet S2-1. Accordingly, it is possible to accurately decrease the conveyance space (distance between paper sheets) between the first sheet S1-1 and the second sheet S2-1. It is possible to maintain the printing speed of the double-sided printing in the image forming apparatus 1.

The first sheet S1-1, for which the conveyance is restarted, is conveyed along the discharge path P2 after forming the image of the first page thereon by means of the image forming unit 5, and the first sheet S1-1 is discharged to the discharge tray 23*a*. Further, the second sheet S2-1, which is conveyed next to the first sheet S1-1, is conveyed along the discharge path P2 after forming the image of the third page thereon by means of the image forming unit 5, and the second sheet S2-1 is discharged to the discharge tray 23*a*.

Further, the third sheet S3-2, which is conveyed next to the second sheet S2-1, is reversed after being conveyed along the first path P31 in accordance with the process which is the same as or equivalent to that of Step S103. The reversed third sheet S3-1 is conveyed via the second path P32 to the image forming unit 5. The image of the fifth page is formed thereon by means of the image forming unit 5, and then the third sheet S3-1 is conveyed along the discharge path P2 and discharged to the discharge tray 23*a*.

As described above, in the conveyance control performed for the sheet S by the controller 9 during the double-sided printing, when the forward end of the second sheet S2-2 arrives at the predetermined position, for example, the position disposed before the flapper 79 in the conveyance path P1, if the back end of the first sheet S1-1 has passed through the first path P31, then the conveyance switching control is executed. In other words, the controller 9 is operated such that the second sheet S2-2 is conveyed to the first path P31, and then the reversed second sheet S2-1 is conveyed to the second path P32. On the other hand, when the forward end of the second sheet S2-2 arrives at the predetermined position, for example, the position disposed before the flapper 79 in the conveyance path P1, if the back end of the first sheet S1-1 does not have passed through the first path P31, then the high speed conveyance control is executed. In other words, the controller is operated such that the second sheet S2-2 is conveyed to the discharge path P2, and then the reversed second sheet S2-1 is conveyed to the second path P32.

In the image forming apparatus 1, if the conveyance of the second sheet S2-2 to be subjected to the printing on the back surface (fourth page) is delayed, for example, due to any mistake in the paper feed, and the first path P32 is in the vacant state, then the conveyance switching control is performed such that the second sheet S2-2, for which the printing has been terminated on the back surface (fourth page), is conveyed to the first path P31, and the second sheet S2-2 is reversed. The second sheet S2-2 protrudes upwardly with respect to the upper surface 23 from the upper surface opening 23*b* of the main apparatus body 2, and hence the second sheet S2-2 can be suppressed from being touched by the user. Further, the second sheet S2-2, which protrudes from the upper surface opening 23*b*, can be suppressed from making contact with the sheet S having been already discharged to the discharge tray 23*a* and from extruding the same.

On the other hand, if any delay does not occur in the conveyance of the second sheet S2-2 for which the printing is performed on the back surface (fourth page), the high speed conveyance control is performed such that the second sheet S2-2, for which the printing has been terminated on the back surface (fourth page), is reversed in the discharge path P2. Accordingly, it is possible to realize the high speed of the double-sided printing.

In this embodiment, the conveyance control has been explained, which is performed when the double-sided printing is performed on the sheet S supported by the sheet cassette 31. However, there is no limitation thereto. The conveyance control for the sheet S according to this embodiment can be also applied to the conveyance control for performing the double-sided printing on the sheet S supported by any other sheet tray such as the front cover 29 or the like.

Effect of this Embodiment

In this embodiment, the image forming apparatus 1 is configured as described above.

That is, the image forming apparatus 1 is provided with the main apparatus body 2 which has the image forming unit 5 and the discharge tray 23*a*, and the controller 9. The main apparatus body 2 includes the conveyance path P1 along which the sheet S allowed to pass through the image forming unit 5 is conveyed, the discharge path P2 which is branched from the conveyance path P1 and which is connected to the discharge tray 23*a*, and the reconveyance path P3 which has the first path P31 branched from the conveyance path P1 for temporarily conveying the sheet S and the second path P31 branched from the discharge path P2 and the first path P31 for conveying the sheet S to the image forming unit 5. The controller 9 is operated during the double-sided printing in which the sheet S conveyed from the image forming unit 5 is conveyed again to the image forming unit 5 via the second path P32 such that when the forward end of the second sheet S2-2 arrives at the predetermined position in the conveyance path P1 after feeding the second sheet S2-2 to be fed next to the first sheet S1-2, then the second sheet S2-2 is conveyed to the first path P31 and then the second sheet S2-2 is conveyed to the second path P32 if the back end of the first sheet S1-1 has passed through the first path P31. On the other hand, when the forward end of the second sheet S2-2 arrives at the predetermined position in the conveyance path P1, then the second sheet S2-2 is conveyed to the discharge path P2 and then the second sheet S2-2 is conveyed to the second path P32 if the back end of the first sheet S1-1 does not have passed through the first path P31.

If the conveyance of the second sheet S2-2 for printing the back surface (fourth page) thereon is delayed, for example, due to any mistake in the paper feed, and the first path P32 is in the vacant state, then the second sheet S2-2, for which the printing is terminated on the back surface (fourth page), is conveyed to the first path P31. The second sheet S2-2 protrudes upwardly with respect to the upper surface 23 from the upper surface opening 23*b* of the main apparatus body 2, and thus the second sheet S2-2 can be suppressed from being touched by the user. Further, the second sheet S2-2, which protrudes from the upper surface opening 23*b*, can be suppressed from making contact with the sheet S having been already discharged to the discharge tray 23*a* and from extruding the same. On the other hand, if any delay does not occur in the conveyance of the second sheet S2-2 for which the printing is performed on the back surface (fourth page), the controller 9 is operated such that the second sheet S2-2, for which the printing is terminated on the back surface (fourth page), is conveyed to the discharge path P2. Thus, it is possible to realize the high speed of the double-sided printing.

Further, the downstream end P31*d* of the first path P31 disposed in the sheet conveyance direction is positioned upwardly as compared with the downstream end P2*d* of the discharge path P2 disposed in the sheet conveyance direction, and the sheet S, which is conveyed from the conveyance path P1, is guided by the first path P31 to the position disposed over or above the discharge tray 23*a*.

The sheet S, which protrudes from the first path P31, protrudes upwardly as compared with the sheet S which is discharged from the discharge path P2 to the discharge tray 23*a*. Therefore, it is possible to suppress the sheet S protruding from the first path P31 from making contact with the sheet S having been already discharged to the discharge tray 23*a*. Further, the length of the first path P31 is longer than the length of the discharge path P2, and the protruding length of the sheet S protruding from the first path P31 is shorter than the protruding length of the sheet S protruding from the discharge path P2. Therefore, it is possible to further suppress the sheet S protruding from the first path P32 from making contact with the sheet S having been discharged to the discharge tray 23*a*.

Further, the image forming apparatus 1 further comprises the discharge unit 100 which is attachable/detachable with respect to the main apparatus body 2, and the first path P31 is arranged on the opposite side with respect to the discharge tray 23*a* with the discharge unit 100 intervening therebetween.

According to the configuration as described above, the sheet S, which protrudes upwardly from the first path P31, protrudes upwardly at the back of the discharge unit 100. Therefore, the sheet S, which temporarily protrudes from the first path P31 when the sheet S is reversed in the first path P31, is hidden by the discharge unit 100, and the sheet S is hardly recognizable visually by the user who stands on the side of the discharge tray 23*a* disposed frontwardly as compared with the discharge unit 100. Accordingly, the protruding sheet S can be suppressed from being removed by the user.

Further, the image forming apparatus 1 further comprises the flapper 79 which is capable of switching the position between the first position at which the sheet S conveyed along the conveyance path P1 is guided to the discharge path P2 and the second position at which the sheet S conveyed along the conveyance path P1 is guided to the first path P31. Then, the controller 9 positions the flapper 79 at the first position if the second sheet S2-2 is conveyed to the discharge path P2, or the controller 9 positions the flapper 79 at the second position if the second sheet S2-2 is conveyed to the first path P31.

In this way, the controller 9 switches the flapper 79 to have the first position or the second position, and thus the conveyance destination of the sheet S can be switched to the discharge path P2 or the first path P32 at the appropriate timing.

Further, the controller 9 positions the flapper 79 at the second position before the forward end of the first sheet S1-2 conveyed along the conveyance path P1 arrives at the flapper 79, and the flapper 79 is switched to have the first position after the back end of the first sheet S1-2 conveyed along the first path P1 passes through the flapper 79. Then, when the forward end of the second sheet S-2-2 arrives at the predetermined position in the conveyance path P1, then the flapper 79 is switched to have the second position if the back end of the first sheet S1-1 conveyed from the first path P31 to the second path P32 passes through the flapper 79. On the other hand, when the forward end of the second sheet S-2-2 arrives at the predetermined position in the conveyance path P1, then the flapper 79 is maintained at the first position if the back end of the first sheet S1-1 conveyed from the first path P31 to the second path P32 does not pass through the flapper 79.

Accordingly, the second sheet S2-2 can be guided to the discharge path P2, while suppressing any unnecessary switching of the flapper 79. Further, when the first sheet S1-2 is reversed in the first path P31, and the reversed first sheet S1-1 is conveyed toward the second path P32, then such a state is given that the flapper 79 is switched to the first position. Therefore, it is possible to stabilize the conveyance of the first sheet S1-1.

Further, the image forming apparatus 1 further comprises the sheet cassette 31 which supports the sheet S fed to the image forming unit 5, the first sensor 91 which is provided between the sheet cassette 31 and the image forming unit 5 and which detects the sheet S, the second sensor 92 which is provided in the second path P32 and which detects the sheet S, and the reverse roller 74 which is provided in the first path P31 and which is capable of switching the rotation direction to the forward rotation direction in which the sheet S is conveyed in the direction to make separation from the conveyance path P1 and the reverse rotation direction in which the sheet S is conveyed toward the second path P32. The controller 9 determines whether the second sheet S2-2 is conveyed to the discharge path P2 or the second sheet S2-2 is conveyed to the first path P31, depending on whether or not the first sensor 91 detects the forward end of the second sheet S2-2, if the second sensor 92 detects the forward end of the first sheet S1-1 after the rotation direction of the reverse roller 74 for conveying the first sheet S1-2 is switched from the forward rotation direction to the reverse rotation direction.

The controller 9 determines whether the second sheet S2-2 is conveyed to the discharge path P2 or the second sheet S2-2 is conveyed to the first path P31 as described above. Therefore, it is possible to accurately make the determination to determine what control is to be executed.

Further, the image forming apparatus 1 further comprises the reconveyance roller 76*a*, 76*b* which is provided in the second path P32 and which conveys the sheet S. The controller 9 is operated such that driving of the reconveyance roller 76*a*, 76*b* is stopped in the state in which the reconveyance roller 76*a*, 76*b* interposes the first sheet S1-1, while the driving of the reconveyance roller 76*a*, 76*b* is restarted on the basis of the fact that the second sheet S1-1 is conveyed toward the second path P32.

Accordingly, it is possible to accurately shorten the conveyance space (distance between paper sheets) between the first sheet S1-1 and the second sheet S2-1. It is possible to maintain the printing speed of the double-sided printing in the image forming apparatus 1.

What is claimed is:

1. An image forming apparatus comprising:

a main apparatus body having an image forming unit and a discharge tray; and a controller, wherein the main apparatus body includes:

a conveyance path along which a sheet passed through the image forming unit is conveyed;

a discharge path which is branched from the conveyance path and which is connected to the discharge tray; and a reconveyance path having a first path and a second path, the first path being branched from the conveyance path and different from the discharge path, the second path being branched from the discharge path and the first path and for conveying the sheet to the image forming unit, and in a case of executing double-sided printing in which the sheet passed through the image forming unit is conveyed again to the image forming unit via the second path, under a condition that a second sheet is fed next to a first sheet, and that the first sheet has passed through the first path when a forward end of the second sheet arrives at a predetermined position in the conveyance path, the controller is configured to convey the second sheet to the first path and then convey the second sheet to the second path, and under a condition that the first sheet has not passed through the first path when the forward end of the second sheet arrives at the predetermined position in the conveyance path, the controller is configured to convey the second sheet to the discharge path and then convey the second sheet to the second path without allowing the second sheet to pass through the first path.

2. The image forming apparatus according to claim 1, wherein a downstream end of the first path in a sheet conveyance direction is positioned upwardly as compared with a downstream end of the discharge path in the sheet conveyance direction.

3. The image forming apparatus according to claim 2, wherein the first path is configured to guide the sheet, which is conveyed from the conveyance path, to a position above the discharge tray.

4. The image forming apparatus according to claim 2, further comprising a cover which is detachably attachable to the main apparatus body, the cover defining a part of first path.

5. The image forming apparatus according to claim 1, further comprising a path switching unit configured to be switchable between a first position at which the sheet conveyed along the conveyance path is guided to the discharge path and a second position at which the sheet conveyed along the conveyance path is guided to the first path, wherein the controller is configured to:

position the path switching unit at the first position in a case that the second sheet is conveyed to the discharge path; and position the path switching unit at the second position in a case that the second sheet is conveyed to the first path.

6. The image forming apparatus according to claim 5, wherein the controller is configured to:

position the path switching unit at the second position before a forward end of the first sheet conveyed along the conveyance path arrives at the path switching unit;

switch the path switching unit to the first position after the first sheet conveyed along the first path passes through the path switching unit;

under a condition that a back end of the first sheet conveyed from the first path to the second path passes through the path switching unit when the forward end of the second sheet arrives at the predetermined position in the conveyance path, switch the path switching unit to the second position; and under a condition that the back end of the first sheet conveyed from the first path to the second path does not pass through the path switching unit when the forward end of the second sheet arrives at the predetermined position in the conveyance path, maintain the path switching unit at the first position.

7. The image forming apparatus according to claim 1, further comprising a reconveyance roller provided in the second path and configured to convey the sheet, wherein the controller is configured to:

stop driving of the reconveyance roller in a state where the reconveyance roller interposes the first sheet; and restart the driving of the reconveyance roller based on that the second sheet is conveyed toward the second path.

8. An image forming apparatus comprising:

a main apparatus body having an image forming unit and a discharge tray;

an optional device which is detachably attachable to the main apparatus body, and a controller, wherein the main apparatus body includes:

a conveyance path along which a sheet passed through the image forming unit is conveyed;

a discharge path which is branched from the conveyance path and which is connected to the discharge tray; and a reconveyance path having a first path and a second path, the first path being branched from the conveyance path and different from the discharge path, the second path being branched from the discharge path and the first path and for conveying the sheet to the image forming unit, wherein a downstream end of the first path in a sheet conveyance direction is positioned on an opposite side to the discharge tray with the optional device intervening therebetween, and in a case of executing double-sided printing in which the sheet passed through the image forming unit is conveyed again to the image forming unit via the second path, under a condition that a second sheet is fed next to a first sheet, and that the first sheet has passed through the first path when a forward end of the second sheet arrives at a predetermined position in the conveyance path, the controller is configured to convey the second sheet to the first path and then convey the second sheet to the second path, and under a condition that the first sheet has not passed through the first path when the forward end of the second sheet arrives at the predetermined position in the conveyance path, the controller is configured to convey the second sheet to the discharge path and then convey the second sheet to the second path.

9. The image forming apparatus according to claim 8, wherein the optional device has an optional path configured to be connected to the discharge path.

10. An image forming apparatus comprising:

a main apparatus body having an image forming unit and a discharge tray; and a controller, wherein the main apparatus body includes:

a conveyance path along which a sheet passed through the image forming unit is conveyed;

a discharge path which is branched from the conveyance path and which is connected to the discharge tray; and a reconveyance path having a first path and a second path, the first path being branched from the conveyance path and different from the discharge path, the second path being branched from the discharge path and the first path and for conveying the sheet to the image forming unit, wherein the image forming apparatus further comprises:

a sheet tray configured to support the sheet to be fed to the image forming unit;

a first sensor provided between the sheet tray and the image forming unit;

a second sensor provided in the second path; and a reverse roller provided in the first path and which is capable of switching a rotation direction to a forward rotation direction in which the sheet is conveyed in a direction away from the conveyance path and a reverse rotation direction in which the sheet is conveyed toward the second path, and in a case of executing double-sided printing in which the sheet passed through the image forming unit is conveyed again to the image forming unit via the second path, under a condition that a second sheet is fed next to a first sheet, and that the first sheet has passed through the first path when a forward end of the second sheet arrives at a predetermined position in the conveyance path, the controller is configured to convey the second sheet to the first path and then convey the second sheet to the second path, and under a condition that the first sheet has not passed through the first path when the forward end of the second sheet arrives at the predetermined position in the conveyance path, the controller is configured to convey the second sheet to the discharge path and then convey the second sheet to the second path, wherein the controller is configured to determine whether the second sheet is conveyed to the discharge path or the second sheet is conveyed to the first path, based on whether the first sensor detects the forward end of the second sheet, under a condition that the second sensor detects the first sheet after the rotation direction of the reverse roller for conveying the first sheet is switched from the forward rotation direction to the reverse rotation direction.

* * * * *